US005930002A

United States Patent [19]

Haneda et al.

[11] Patent Number: 5,930,002

[45] Date of Patent: Jul. 27, 1999

[54] IMAGE FORMING APPARATUS HAVING A SINGLE-BODY IMAGE FORMING DRUM UNIT

[75] Inventors: Satoshi Haneda; Hisayoshi Nagase; Hiroyuki Tokimatsu; Masahiro Onodera; Shuta Hamada, all of Hachioji; Toshihide Miura, Koganei, all of Japan

[73] Assignee: Konica Corporation, Japan

[21] Appl. No.: 08/854,923

[22] Filed: May 13, 1997

[30] Foreign Application Priority Data

| | | | |
|---|---|---|---|
| May 16, 1996 | [JP] | Japan | 8-121548 |
| Sep. 2, 1996 | [JP] | Japan | 8-231839 |
| Sep. 30, 1996 | [JP] | Japan | 8-259134 |

[51] Int. Cl.[6] ..... G03G 15/00

[52] U.S. Cl. ..... 358/300; 399/118; 399/116

[58] Field of Search ..... 399/116, 117, 399/118, 90, 115, 110, 111, 112, 113; 347/138, 152; 358/296, 298, 300

[56] References Cited

U.S. PATENT DOCUMENTS

| | | | |
|---|---|---|---|
| 5,541,722 | 7/1996 | Ikeda et al. | 355/326 R |
| 5,557,394 | 9/1996 | Haneda et al. | 355/327 |
| 5,585,893 | 12/1996 | Fujita et al. | 355/228 |
| 5,600,408 | 2/1997 | Horiuchi et al. | 399/39 |
| 5,608,498 | 3/1997 | Nagase et al. | 399/130 |
| 5,660,960 | 8/1997 | Kinoshita et al. | 399/159 |
| 5,722,013 | 2/1998 | Nagase et al. | 399/112 |
| 5,752,137 | 5/1998 | Haneda | 399/223 |
| 5,784,672 | 7/1998 | Haneda et al. | 399/118 |

*Primary Examiner*—Shawn Riley
*Assistant Examiner*—Derek J. Jardieu
*Attorney, Agent, or Firm*—Jordan B. Bierman; Bierman, Muserlian and Lucas

[57] ABSTRACT

An image forming apparatus comprises a photoreceptor drum, a supporting member provided inside the photoreceptor drum and supporting plural exposure devices; and a signal passage to transmit an image signal to the plural exposure devices. The signal passage connects the outside and the inside of the photoreceptor drum by passing a part of the supporting member.

10 Claims, 27 Drawing Sheets

FIG. 23 ( a )
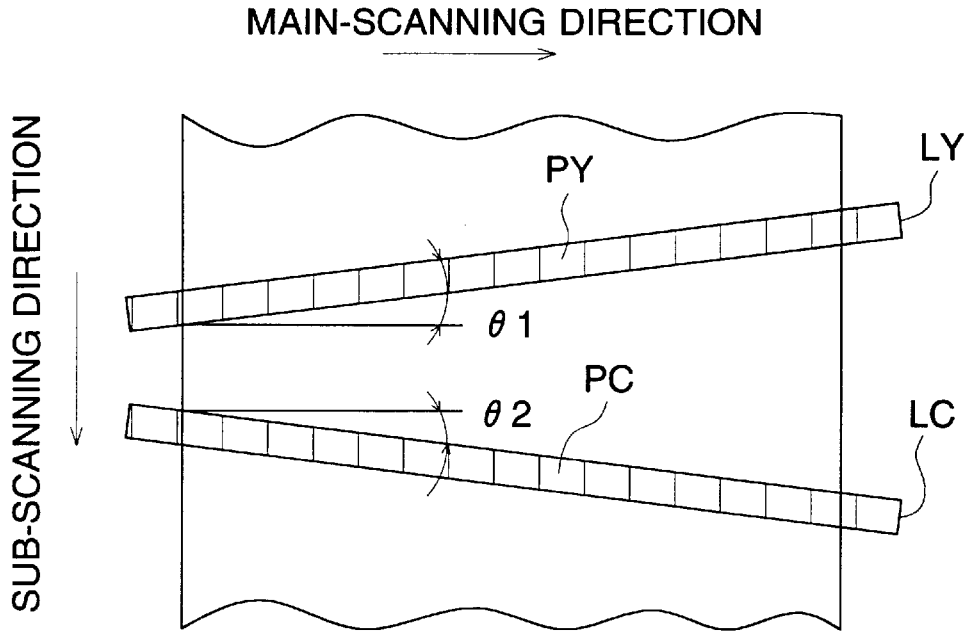
FIG. 23 ( b )
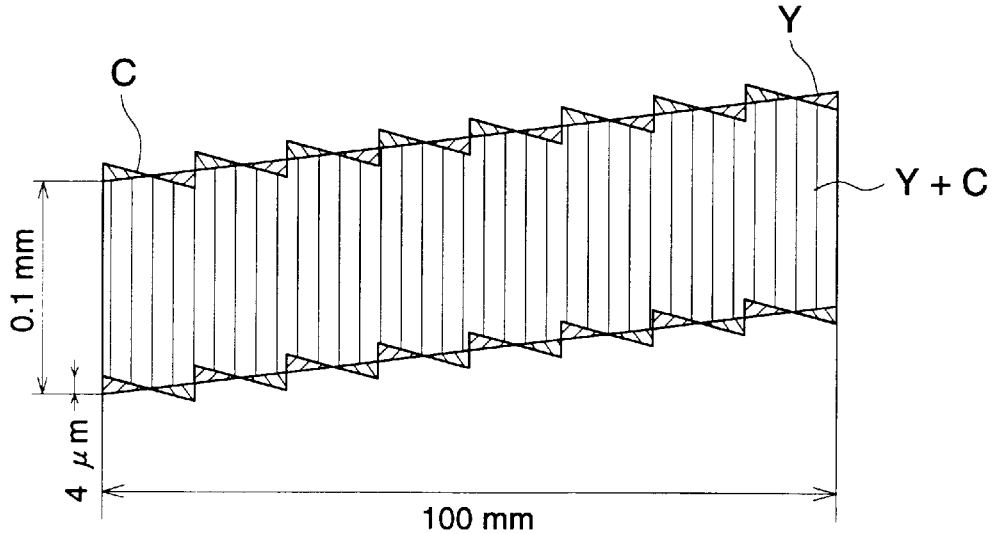

FIG. 26 ( a )
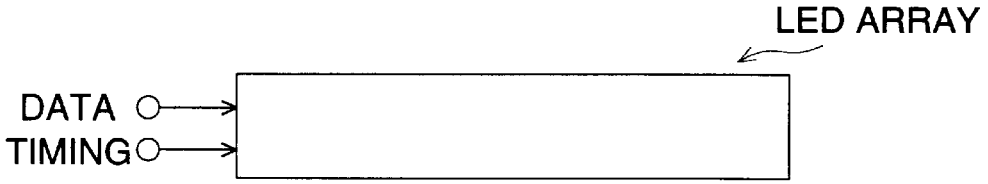
FIG. 26 ( b )
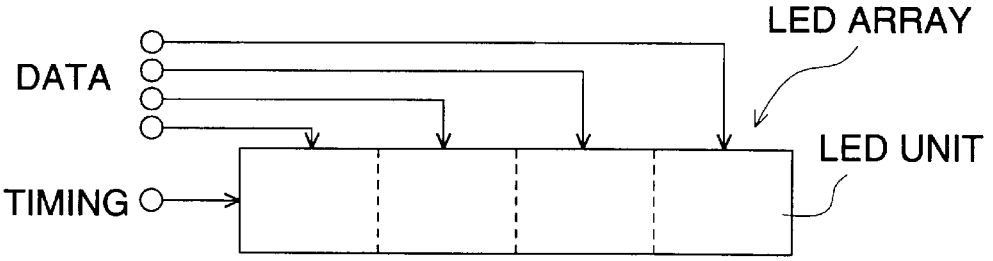
FIG. 26 ( c )
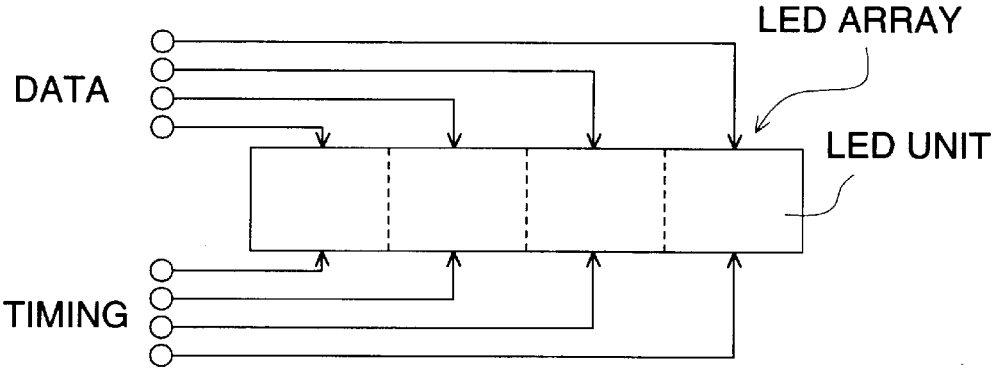

IMAGE FORMING APPARATUS HAVING A SINGLE-BODY IMAGE FORMING DRUM UNIT

BACKGROUND OF THE INVENTION

The present invention relates to an image forming apparatus to conduct an image formation in an electrophotographic method with an arrangement in which an image exposing means is provided in an photoreceptor drum and a charging means and a developing means are provided on the external periphery of the photoreceptor drum, in a copying machine, a printer, or a facsimile machine.

As a method of forming a multi-color image, the following color image forming apparatus are known: (1) there are provided photoreceptor drums, charging devices and developing devices whose number are identical to that of colors necessary for a color image formation and a color image is formed by transferring a monochromatic toner image from a photoreceptor drum to a recording sheet by a transfer device and by superimposing plural monochromatic toner images on the recording sheet, (2) a photoreceptor drum is rotated plural times so that charging, image exposure and developing for each color are repeated for forming a full color image, and (3) charging, image exposure and developing are successively conducted during one rotation of the photoreceptor drum for forming a color image.

However, the color image forming apparatus (1) has drawback to become a large size in volume since it is necessary to provide plural photoreceptor drums and a device to convey recording sheets to the drums. On the other hand, the color image forming apparatus (2) has a merit that a volume of the apparatus can be made small. However, a size of the image is limited to a size smaller than the surface of the photoreceptor drum.

The color image forming apparatus (3) has merits that there is no limitation in the image size and that an image can be formed at a high speed. However, since plural charging devices, plural image exposing devices and plural developing devices are provided around the external periphery of the photoreceptor drum, a size of the apparatus becomes large. To make a size of an apparatus smaller, Japanese patent unexamined publication (Tokukaihei 5-307307) discloses an image forming apparatus (4) in which a transparent drum is used as a base drum of a photoreceptor drum and image exposing means are provided in the photoreceptor drum.

In the apparatus (4), since plural image exposing devices are provided inside the photoreceptor drum, a mounting structure of the photoreceptor drum becomes complicate. Further, lead wires are connected for exposure elements of the exposing devices and the lead wires are needed to be drawn out of the photoreceptor drum and construction members to mount the photoreceptor drum. In the time of mounting, dismounting or replacing the photoreceptor drum, the lead wires is brought in contact with the photoreceptor drum or the construction members and the weight of the drum or the members are loaded on the lead wires. As a result, the lead wires are broken or the image exposing elements are deformed by being pulled with the lead wires. The deformed image exposing elements causes deviation of image light or out of image focus.

Further, on supporting members on which the exposing devices are mounted, there are provided a transfer-simultaneous exposing means for conducting uniform exposure simultaneously with transferring operation, a light detecting means for conducting toner concentration correction and γ-correction and a memory member for memorizing positional registration information in the time of incorporating the exposure devices in the photoreceptor drum and information as to photoreceptor characteristic. In addition to the lead wires for the exposing devices, lead wires connected to the transfer-simultaneous exposing means, the light detecting means and the memory member. In the time of mounting, dismounting or replacing the photoreceptor drum, the lead wires is brought in contact with the photoreceptor drum or the construction members and the weight of the drum or the members are loaded on the lead wires. As a result, the lead wires may be broken or the transfer-simultaneous exposing means, the light detecting means and the memory member may be shifted by being pulled with the lead wires or may be deformed. The transfer-simultaneous exposing means, the light detecting means and the memory member may not function normally.

Further, through a window provided on constructing members to mount the photoreceptor drum in order to draw the lead wires to the outside, scattering toner and dust come inside the image forming apparatus and soil the image exposing means and the light detecting means, resulting in malfunction of the exposing means and the light detecting means.

As another problem in the above apparatus (4), when replacing the photoreceptor drum with a spare one due to the reason that a usable time period of the photoreceptor is ended when a predetermined number of copy sheets are used, correction for positional registration between the photoreceptor drum and the image exposing means is needed. Further, in the time of initially setting an image forming apparatus or in the time of replacing the photoreceptor drum, correction for photoreceptor drum characteristic and correction for exposure amount of image exposing means are needed. The correction becomes troublesome and complicate.

SUMMARY OF THE INVENTION

The first objective of the present invention is to provide an image forming apparatus in which lead wires are prevented from being loaded a weight of exposing means, transfer-simultaneous exposing means, light detecting means and memory member in the time of mounting, dismounting or replacing a photoreceptor drum.

The second objective of the present invention is to provide an image forming apparatus in which it is not necessary to conduct correction for positional registration of image exposing means, correction for photoreceptor drum characteristic and correction for exposure amount for each replacement of the photoreceptor drum.

In an image forming apparatus comprising a rotatable image forming member and an image exposing means incorporated inside the image forming member, the first objective is attained by the image forming apparatus characterized in that a relay terminal is provided on a side of a supporting member which is incorporated inside the image forming member and supports the image exposing means so that lead wire from the supporting member is relayed and drawn outside through the relay terminal.

In an image forming apparatus comprising a rotatable image forming member and an image exposing means incorporated inside the image forming member, the above objective is attained by the image forming apparatus characterized in that a window is provided on a supporting member and lead wires provided on the image exposing means are drawn out of the supporting member through the window.

In an image forming apparatus comprising a rotatable image forming member and an image exposing means incorporated inside the image forming member, the above objective is attained by the image forming apparatus characterized in that the image forming member and the image exposing member are made in one body as an image forming unit, a hole is provided at one side of the image forming unit in which the image exposing means is incorporated, a through hole or a cut-out is provided so as to face the above hole on a holding member which is provided outside the image forming unit and holds the image forming unit, and lead wires provided on the image exposing means are drawn out of the image forming unit through the hole on the supporting member and the through hole or the cut-out on the holding member.

In an image forming apparatus comprising a rotatable image forming member and an image exposing means incorporated inside the image forming member, the second objective is attained by the image forming apparatus characterized in that a memory member for memorizing positional registration information of the image exposing means in the time of imagewise exposing onto the image forming member is provided in one body with the image exposing means, the positional registration information is read out of the image forming member from the memory member and image data based on the positional registration information are transmitted inside the image forming member.

BRIEF DESCRIPTION OF THE DRAWINGS

FIGS. 23(*a*) and 23(*b*) are explanatory views showing a first example of a result of the exposing timing control of the invention.

FIGS. 26(*a*) to 26(*c*) are explanatory views showing a conventional exposing timing control system.

DETAILED DESCRIPTION OF THE PREFERRED EMBODIMENT

An example of the present invention will be described below. In this connection, descriptions in the present section are not intended to limit the technological scope of claims, or meanings of terms. Further, conclusive explanations in examples of the present invention below only show a best mode of the example, and does not limit meanings of terms or the scope of technology of the present invention.

Figure 1:
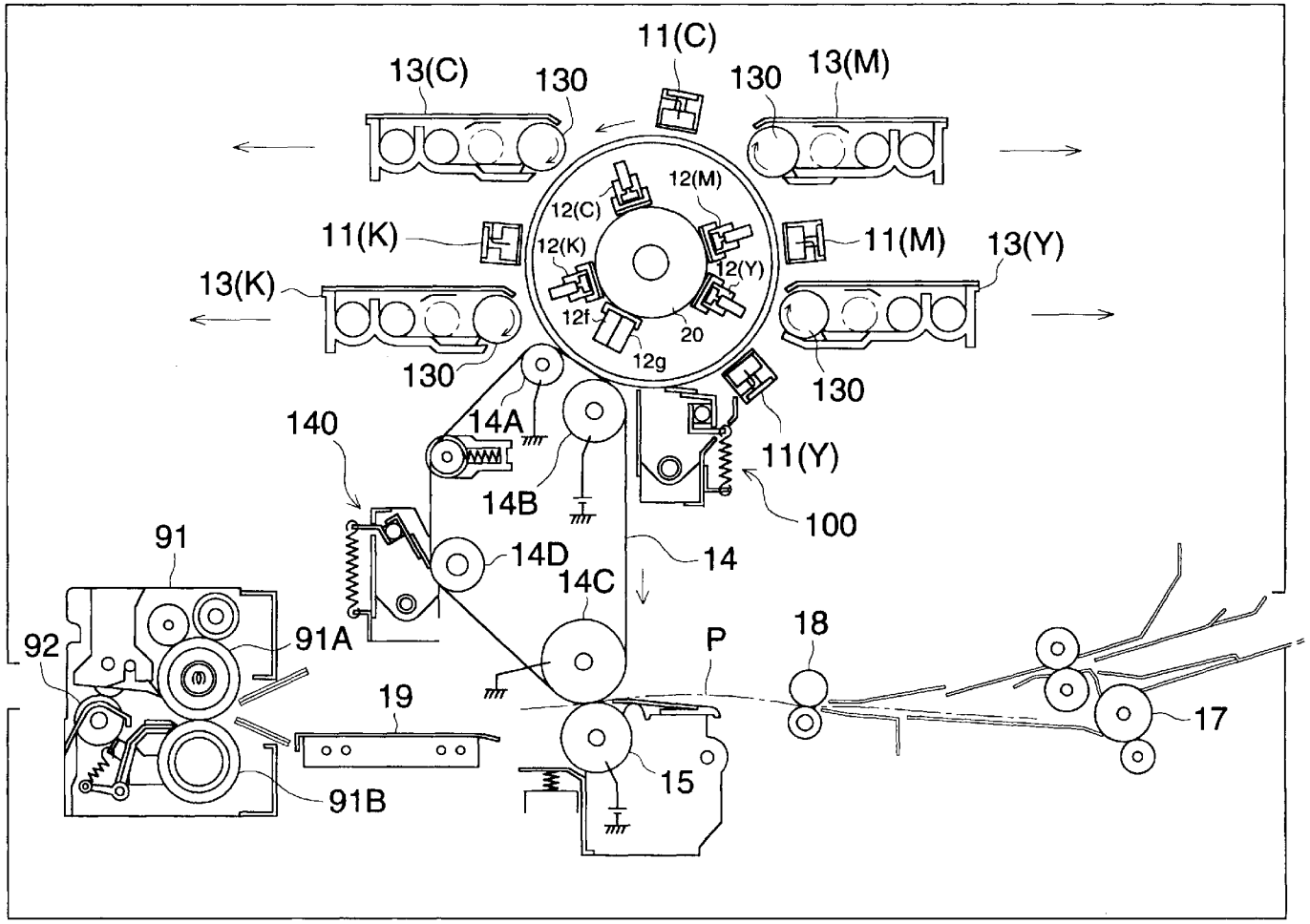
FIG. 1 is a sectional view showing a structure of a color image forming apparatus as one example of the present invention.
Figure 2:
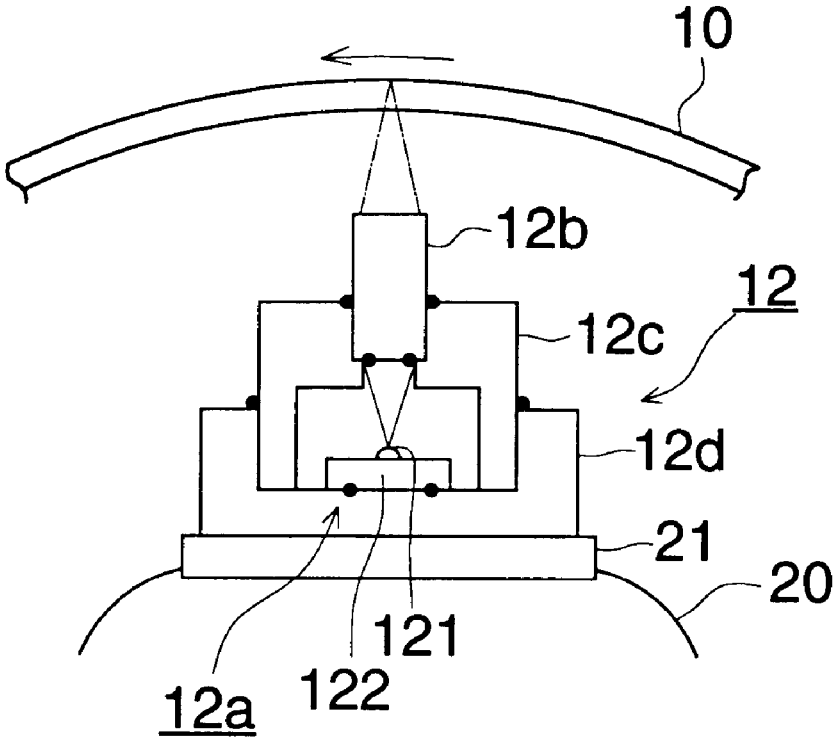
FIG. 2 is an enlarged section view of a primary section of an imagewise exposing means of FIG. 1.
Figure 3:
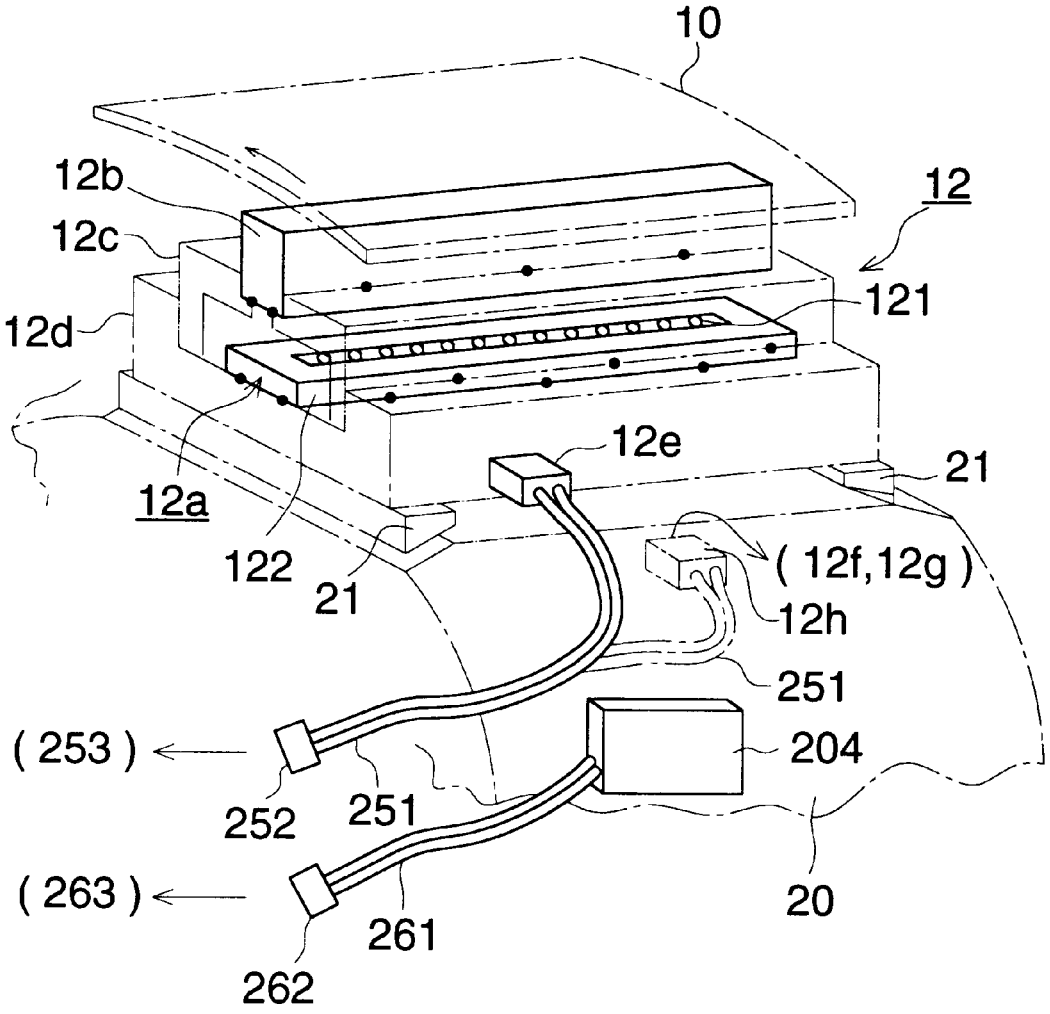
FIG. 3 is a perspective view of FIG. 2.
Figure 4:
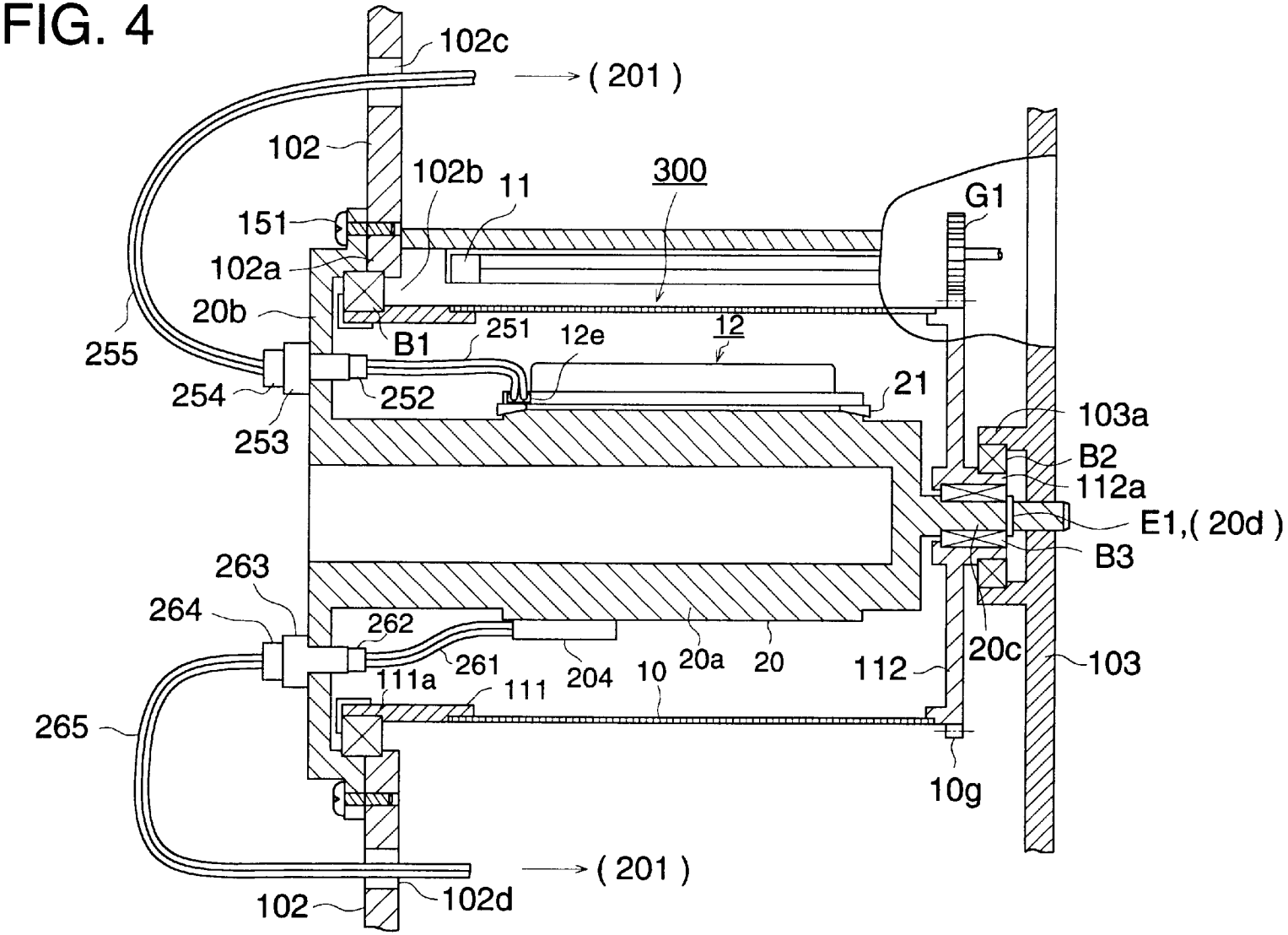
FIG. 4 is a sectional view showing a first example of a technique to mount a photoreceptor drum onto a casing in the first embodiment of the present invention as to the wiring arrangement of a lead wire.
Figure 5:
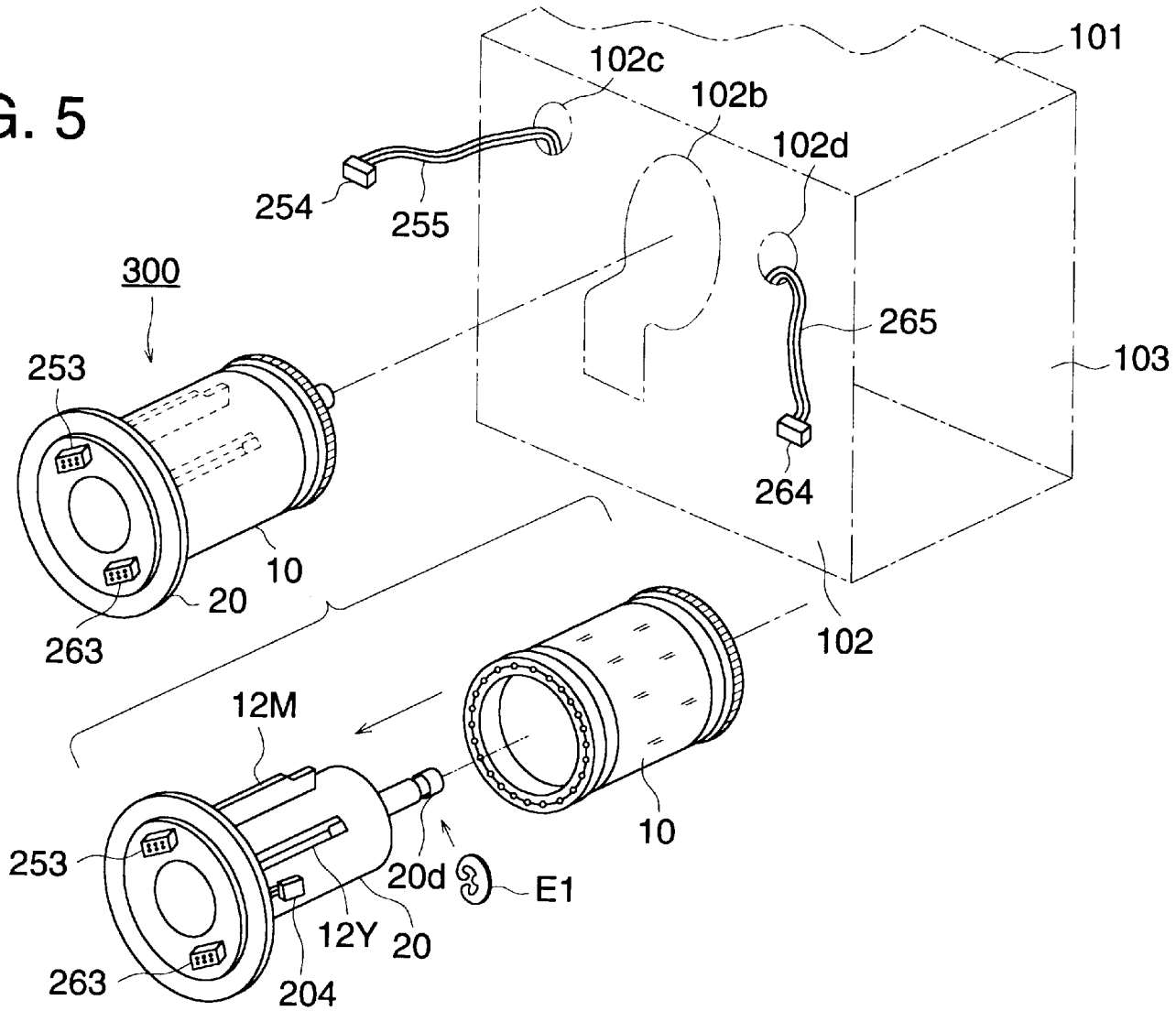
FIG. 5 is a illustration showing an outline of the assembling way for the structure in FIG. 4.

An image forming process and the structure of an image forming apparatus of one example of the present invention is explained with reference to FIGS. 1 to 5. FIG. 1 is a sectional view of the image forming apparatus of one example of the present invention. FIG. 2 is an enlarged section view of a primary section of an imagewise exposing means of FIG. 1. FIG. 3 is a perspective view of FIG. 2. FIG. 4 is a sectional view showing a first example of a technique to mount an image forming member onto a casing in the first embodiment of the present invention as to the wiring arrangement of a lead wire. FIG. 5 is a illustration showing an outline of the assembling way.

In FIGS. 1 and 4, photoreceptor drum 10, which is a drum-shaped image forming body, is provided therein with a cylindrical resin substrate formed with a transparent member made of a transparent acrylic resin. The substrate is provided with transparent conductive layer and organic photoreceptor layer (OPC) on the outer circumference thereof. Aforesaid photoreceptor drum is rotated clockwise as shown by an arrow in FIG. 1 while being grounded.

In the present embodiment, the photoreceptor drum may incorporate an exposure light amount capable of providing an appropriate contrast in the photoconductive layer. Therefore, the light transmission ratio of the transparent resin substrate for the photoreceptor drum in the present embodiment need not necessarily be 100%. The substrate may also have a property in which exposure beams may be absorbed to some extent when the exposure beams transmits through the transparent substrate. As material of the transparent substrate, acrylic resin-polymerized materials are so excellent in terms of transparency, strength, accuracy and surface properties as to be preferably used. In addition, various translucent resins such as acrylic, fluorine, polyester, polycarbonate and polyethylene terephthalate which are used in ordinary members are also usable. Aforesaid resins may be colored provided that they have translucency against exposed beam. The refractive index of aforesaid resins is almost 1.5. As a layer forming method of the translucent conductive layer, by the use of a vacuum deposition method, an active reaction deposition method, any spattering method, any CVD method, a thin layer maintaining translucency composed of indium, tin, oxidized products, aluminum, tin oxide, lead oxide, indium oxide, copper iodide, Au, Ag, Ni and Al are produced. In addition, by the use of dip coating methods and spray coating methods, conductive resins composed of the above-mentioned fine particles of metals and binder resins can be prepared. In addition, as a photoconductive layer, each organic photoreceptor layer (OPC) are usable.

As a manufacturing method for a basic drum from a light permeable resin, by centrifugal polymerization, a basic cylinder with high accuracy is manufactured. In this method, firstly, monomer of a plastic material is synthesized. After catalyst is added into the monomer, the monomer is supplied in a cylindrical mold and then the cylindrical mold is closed with a side plate. By heating the cylindrical mold with a proper temperature while rotating the cylindrical mold, uniform polymerization is advanced. After the polymerization ended, the cylindrical mold is cooled. A basic drum made of a light permeable resin is taken away from the cylindrical mold, is cut, and is subject to a finishing process if necessary. In this way, a basic drum of a photoreceptor drum for an image forming apparatus is manufactured. (centrifugal polymerization).

As a material for a basic drum made of light permeable plastic, as described above, a resin polymerized methylester methacrylic acid monomer by means of centrifugal polymerization may be the most preferable in terms of transparency, strength, accuracy and surface property. In addition, polymethacrylic ethyl, polymethacrylic butyl, polyacrylic acid ethyl, polyacrylic acid butyl, polystyrene, polyimide, polyester or polyvinylchloride or their copolymers are usable. According to the centrifugal polymerization method, the roundness is determined by a die used for molding. Therefore, a substrate with high accuracy can be obtained. In addition, the fluctuation of the thickness changes depending upon uneven rotation, viscosity and heating conditions when polymerizing.

By using a basic drum made of a transparent resin manufactured by the above method, it becomes possible to provide a photoreceptor drum in which thickness is uniform, an accuracy in terms of a cylinder and an accuracy in terms of a circle are very good, the manufacturing is easier at lower cost than that using a glass material.

As a layer forming method of a transparent conductive layer, by a vacuum deposition method, an activated reaction deposition method, any type of spattering method, any type of CVD method, a thin layer maintaining a light permeability can be made of indium, tin, oxide (ITO), aluminum, tin oxide, lead oxide, indium oxide, copper iodide, or Au, Ag, Ni, and Al. Further, more preferably, by means of a dip coating method or a spray coating method, a conductive resin layer made of the above transparent conductive particles (such as ITO) and a binder resin may be used. In this case, in order to enhance transparency of the conductive layer, it is preferable to control the size of the diameter of fine particles constituting the conductive layer to 600 Å or less in a in the Rayleigh scattering resin (which is defined to be scattering due to fine particles having the size of diameter with 1/10 or less for the wavelength) wherein light scattering due to image exposure is scarcely found. As an element for constituting conductive fine particles, it is preferable to use fine particles whose primary particle size is 600 Å or less and also to control the central radius to 100 Å or less in terms of transparency and dispersion stability of liquid.

Organic photoreceptor layer 503 is composed of two layers in which its functions are separated into a charge generation layer (CGL) mainly composed of charge generation materials (CGM) and a charge transportation layer (CTL) mainly composed of charge transportation materials (CTM). Since the CGL is thin, the two-layer-constituted organic photoreceptor layer has favorable image exposure beam. Therefore, it is suitable for the present invention. Incidentally, organic photoreceptor drum may comprise a single layer structure containing the charge generation materials (CGM) and the charge transportation materials (CTM) in a single layer. In aforesaid single-layered or the above-mentioned two-layered photoreceptor layer ordinarily contains a binder resin.

Scorotron chargers 11, which are used as a charging means, are used for an image forming process for each of yellow(Y), magenta (M), cyan (C) and black (K) colors. Aforesaid scorotron charger provides charging effect by means of a control grid and discharging electrodes in which potential is maintained to a prescribed level compared with the above-mentioned photoreceptor layer on photoreceptor drum 10, thereby providing uniform potential onto photoreceptor drum 10.

An exposure optical system as an imagewise exposing means for each color of Y, M, C, and K is composed of a line-shaped exposing element 12*a* in which a plurality of LEDs 121 (light emission diode) as light emitting elements are arranged in a array form on a basic plate 122 as a optical system located in a main scanning direction in parallel to an axis of a photoreceptor drum 10 and a light collecting and transmitting members 12*b* (trade name: selfoc lens) as a image focusing element. Selfoc lenses are fixed on a lens holding member 12*c* with adhesive as shown with black points in FIGS. 2 and 3. Also, exposing elements 12*a* are fixed on a metallic casing 12*d* as a good heat conductive metal member with adhesive as shown with black points. On a condition that the exposing elements 12*a* and the selfoc lenses are positioned correctly, the lens holding member 12*c* are fixed on the metallic casing 12*d* with adhesive as shown with black points, thereby constructing the exposure optical system 12.

As an exposure element, FLs (fluorescent light emission), an EL (electroluminescence), PLs (plasma discharge) may be used.

On a condition that the exposure optical systems 12 are positioned correctly by using a special tool in a main scanning direction and a subscanning direction corresponding to a rotating direction of the photoreceptor drum 10, the exposure optical systems 12 are fixed with adhesive on a central cylinder section 20*a* of the supporting member 20 used as a common supporting member for the exposure optical systems of plural color. The supporting member 20 is located inside the photoreceptor drum 10 on a condition that the center axis of the supporting member 20 is conformed to the central axis of the photoreceptor drum 10. Therefore, the imagewise exposure is conducted by the exposure optical system 12 for the photoreceptor drum 10 vertically to the central axis of the photoreceptor drum 10.

Image signals are inputted by reading with an image scanner or from an outside, are memorized in a memorizing section, for example in RAM. The image signals are read out for each color successively from the memorizing section and are inputted as electric signals into the exposure optical systems 12 through the control section. Then, LEDs 121 emit light under pulse width modulation (PWM method). A wavelength of the light emitting elements used in this embodiment is in a range of 600 to 900 nm.

As stated above, the exposure optical systems 12 are mounted on the cylinder section 20*a* of the supporting member 20 and are accommodated inside the photoreceptor drum 10. One end of a lead wire 251 for LED 121 is connected with a connector 12*e* provided on a base plate 122 of the exposure optical systems 12 and the other end of the lead wire 251 is connected with a connector 252.

In addition to the exposure optical systems 12, a transfer-simultaneous exposing device 12*g* as a transfer-simultaneous exposing means and a light detecting sensor 12*f* as a light detecting means used to conduct a toner concentration control, γ-characteristics correction, and exposure amount correction are mounted on the supporting member 20 and are accommodated inside the photoreceptor drum 10. In the same manner stated above, one end of a lead wire 251 for LED 121 is connected with the transfer-simultaneous exposing device 12*g* and the light detecting sensor 12*f* through a connector 12*h* and the other end of the lead wire 251 is connected with a connector 252.

Further, on the supporting member 20 is mounted a ROM (2) 204 as a memory member for memorizing a unit deviation amount which is positional-registration information of the exposure optical systems 12 and a photoreceptor characteristics of the photoreceptor drum 10. One end of a lead wire 261 is connected with the ROM (2) 204 and the other end of the lead wire 261 is connected with a connector 262.

The connectors 252 and 262 are connected with relay terminals 253 and 263 provided on a flange section 20*b* of the supporting member 20.

The four developing devices 13 as a developing means respectively houses yellow (Y), magenta (M), cyan (C) or black (K) developer. The developing devices maintain a prescribed gap from the circumference of photoreceptor 10, and are provided with development sleeves 130 which rotate in the same direction as the rotation direction of photoreceptor drum 10 at developing position.

The developing devices for each color conduct the reversal development for electrostatic latent images on photoreceptor drum 10 formed due to charging by means of the scorotron chargers 11 and image exposure by means of exposure units 12 under non-contact state by means of a non-contact development method due to applying the development bias voltage.

With regard to the original images, images read by an image sensor in an image reading device separately provided from the present apparatus or images edited by a computer are temporally stored in the memory as images for each of Y, M, C and K colors.

When starting image recording, a driving motor for the photoreceptor (not illustrated) is driven so that photoreceptor drum 10 is rotated clockwise as shown by an arrow in FIG. 1. Simultaneously, provision of potential onto photoreceptor drum 10 starts due to charging effect of Y scorotron charger 11 which is provided to the left of photoreceptor drum 10.

After photoreceptor 10 is provided with potential, in Y exposure unit 12, exposure by means of an electrical signal which corresponds to the first color signal, i.e., Y image data starts. Due to the rotation and scanning of the drum, electrostatic latent images which corresponds to Y images of the original image are formed on the photosensitive layer on the surface of aforesaid drum.

The latent image is developed with the reversal development by Y developing device 13 on the condition that the developer on the development sleeve is in a non-contact state. In accordance with rotation of photoreceptor drum 10, a yellow (Y) toner image is formed in accordance with photoreceptor drum 10.

Next, on the yellow (Y) toner image, photoreceptor drum 10 is provided with potential due to charging effect by magenta (M) scorotron charger 11 which is located to the left of photoreceptor drum 10 and below development casing 138 of magenta (M) developing device 13. Then, in M exposure unit 12, exposure by means of an electrical signal which corresponds to the second color signal, i.e., M image data starts. Magenta (M) toner image is successively superposed on the yellow (Y) toner image due to non-contact reversal development by means of M developing device 13.

Under the same process, the cyan (C) toner image corresponding to the third color signal due to cyan scorotron charger 11 which is located to the right of photoreceptor drum 10 and above development casing 138 of development device 13, C exposure unit 12 and C developing device 13 and black (K) toner image corresponding to the fourth color signal due to black scorotron charger 11 which is located to the right of photoreceptor drum 10 and above development casing 138 of development device 13, K exposure unit 12 and K developing device 13 are successively superposed so that, as a result, a color toner image is formed on the circumference of photoreceptor drum 10 within one rotation of photoreceptor drum 10.

Organic photosensitive layer on photoreceptor drum 10 is exposed to light from inside the drum through the transparent substrate by means of Y, M, C and K exposure unit 12. Accordingly, image exposure corresponding to the second, third and fourth color signal receives no influence by the toner image superposed in advance so that electrostatic latent image equivalent to an image corresponding to the first color image can be formed. When conducting development by developing devices 13 for each color, development bias of D.C. voltage or D.C. voltage in conjunction with A.C. voltage are applied to development sleeve 131. Jumping development by means of a one-component or two-component developer housed in a developing device is conducted. Onto photoreceptor drum 10 wherein a transparent conductive layer is grounded, D.C. bias having the same polarity as the toner is applied. Thus, non-contact reversal development wherein toner is adhered onto the exposed portion is conducted.

A thus formed color toner image on the photoreceptor drum 10 is transferred onto a circumference of an internal transfer belt 14 provided as an internal transfer means. At this time, in order to conduct an excellent transfer, the uniform exposure is carried out by the transfer simultaneous exposure device 12*d* using, for example, light emitting diodes.

The intermediate transfer belt is a 0.5–2.0 mm thick endless rubber belt, and is structured of 2 layers of a semi-conductive base body, having a resistance value of $10^8$–$10^{12}$ Ω.cm, which is formed of silicon rubber or urethane rubber, and a 5–50 mm thick fluorine coating layer as a toner filming prevention layer, formed on the rubber base body. This layer is also preferably semi-conductive. Instead of the rubber belt base body, a 0.1–0.5 mm thick semi-conductive polyester, polystyrene, polyethylene, polyethylene terephthalate material, etc., may also be used.

The intermediate transfer belt is stretched around roller 14A, 14B, 14C and 14D, and is rotated clockwise in synchronization with the circumferential speed of the photoreceptor drum 10 by the driving force transmitted to the roller 14D.

A belt surface of the intermediate transfer belt 14 between a roller 14A and 14B is contacted with a circumference of the photoreceptor drum 10, and another belt surface of the intermediate transfer belt 14 around the roller 14C is contacted with a transfer roller 15 as a transfer member. The intermediate transfer belt 14 forms transfer sections on these contacting regions.

Firstly, a color toner image formed on the circumference of the photoreceptor drum 10 is transferred successively onto a circumferential surface of the intermediate transfer belt on the contacting region while a bias voltage having a reverse polarity to that of the color toner image is applied onto the roller 14B. Namely, under the application of the bias voltage of 1 to 3 KV on the roller 14B, the color toner image is efficiently transferred onto the intermediate transfer belt 14, and the color toner image on the drum is conveyed to the transfer section with the guide of the grounded roller 14A without causing scattering.

With the action of a sheet feed roller 17 in a sheet cassette, a transfer sheet P is fed out and conveyed to a timing roller 18. Further, in synchronization with the conveyance for the color toner image on the intermediate transfer belt 14, the sheet P is conveyed to the transfer section on the transfer roller 15.

The transfer roller 15 is rotated counterclockwise in synchronization with the circumference speed of the intermediate transfer belt 14. At the transfer section formed at a nip region between the transfer roller 15 and a grounded roller 14C, the color toner image on the intermediate transfer belt 14 comes in contact with the transfer sheet P and is successively transferred to the transfer sheet p under the application of the bias voltage of 1 to 3 KV having a reverse polarity to that of the color toner image onto the transfer roller 15.

After receiving the color toner image, the transfer sheet P is subject to the charge eliminating process and is further conveyed to a fixing device 91 through a conveying plate 19. The transfer sheet is conveyed and sandwiched between a heating roller 91A a pressing roller 91B, and is heated so that the color toner image is melted and fixed onto the transfer sheet P. Thereafter, the transfer sheet P is delivered out of the apparatus by a delivery roller 92.

The photoreceptor drum 10 is equipped with a cleaning device and also the intermediate transfer belt 14 is equipped with a intermediate transfer belt cleaning device 140. Whereby the photoreceptor drum 10 and the intermediate transfer belt 14 are cleaned with a blade to remove remaining toners and the circumferential surface of them is kept clean. After cleaning operation, the blade is kept spaced away from the photoreceptor drum 10 and the intermediate transfer belt 14.

According to FIGS. 4 and 5, a scorotron charging device 11, a developing device 13, and a cleaning device 100 which are the principal structure for an abovementioned image forming process are mounted on a front and rear plates 102 and 103 which construct a casing 101 in the apparatus main body. A drum unit 300 explained later on is inserted in the casing 100, and thereafter, an intermediate transfer belt 14 is also inserted in the casing 100. The intermediate transfer belt 14 is inserted on the condition that it is separated from the photoreceptor drum 10, and the intermediate transfer belt 14 is brought in pressure contact with the photoreceptor drum 10 after being inserted in the casing 100. A bearing B2 shown in FIG. 4 is fit with pressure into a receiving section 103*a* of the rear plate 103.

A gear 10*g* for driving the photoreceptor drum 10 is provided on the end of the photoreceptor drum 10. The photoreceptor drum 10 is supported by being sandwiched between a front flange 111 in which a bearing B1 is inserted with pressure into a receiving section 111*a* and a rear flange 112 in which a bearing B3 is inserted with pressure into a receiving section 112*a*.

A supporting member 20 on which plural exposure optical systems 12 for plural colors, transfer-simultaneous exposing device 12*g*, a sensor 12*f* and ROM(2) 204 are mounted is fit into bearings B1 and B2 which are provided on the front and rear flanges 111 and 112 of the photoreceptor drum 10 respectively so that an axis of the supporting member is supported. Thereafter, E-ring El is engaged in a R-ring groove 20*d* provided on a shaft 20*c* of the supporting member 20, thereby preventing the photoreceptor drum 10 from slipping out of the supporting member 20 and constructing a drum unit 300. A half portion in height of the flange 20*b* of the supporting member 20 is fit into the bearing B1.

The drum unit 300 is inserted through a hole 102*b* of the front plate 102 into the casing 100. The outer periphery surface of the receiving section 112*a* of the rear flange 112 is fit into the bearing B2. On the other hand, The remaining half portion of the bearing B1 whose half portion was previously fit with the supporting member 20 is fit into a receiving section 102*a* of the front plate 102. On the condition that the exposure optical system 12 of each color is disposed at a proper position, the drum unit 300 is fixed to the front and rear plates 102 and 103 by fixing the flange section 20*b* to the front plate 102 with screws 151.

The gear 10*g* provided on the rear flange 112 is engaged with gear G1. Accordingly, the gear 10 is rotated by the gear G1 which is driven and rotated by unillustrated photoreceptor drum-driving motor provided in the apparatus body, whereby the photoreceptor drum 10 is rotated.

A connector 252 provided at a tip end of a lead wire 255 extended from a latermentioned control section 201 in the apparatus body is coupled with a relay terminal 253 with which a lead wire 251 extended from LED 121 of the exposure optical system 12 of each color, the transfer-simultaneous exposing device 12*g* and a light detection sensor 12*f* is coupled. Further, a connector 254 of a lead wire 265 extended from the control section 201 in the apparatus body is coupled with a relay terminal 263 with which a lead wire 261 extended from ROM(2) is coupled. The lead wires 255 and 256 are drawn out from the inside of the casing 101 to the outside through lead wire drawing-out holes 102*c* and 102*d* provided on the front plate 102.

When the drum unit 300 and the photoreceptor drum 10 is replaced with a spare one, connectors 254 and 264 connected with the lead wires 255 and 265 are removed from the relay terminals 253 and 263, and then the screws 151 are removed. Thereafter, by pushing the back end of the shaft

20*c* of the supporting member 20, the drum unit 300 can be drawn out from the hole 102*a* of the front plate 102.

The E-ring E1 is disengaged from the shaft 20*c* of the supporting member 20, and then the photoreceptor drum 10 is removed from the supporting member, thereby replacing the photoreceptor drum 10 with a spare one. Thereafter, the drum unit is assembled and mounted in the manner mentioned above.

Figure 6:
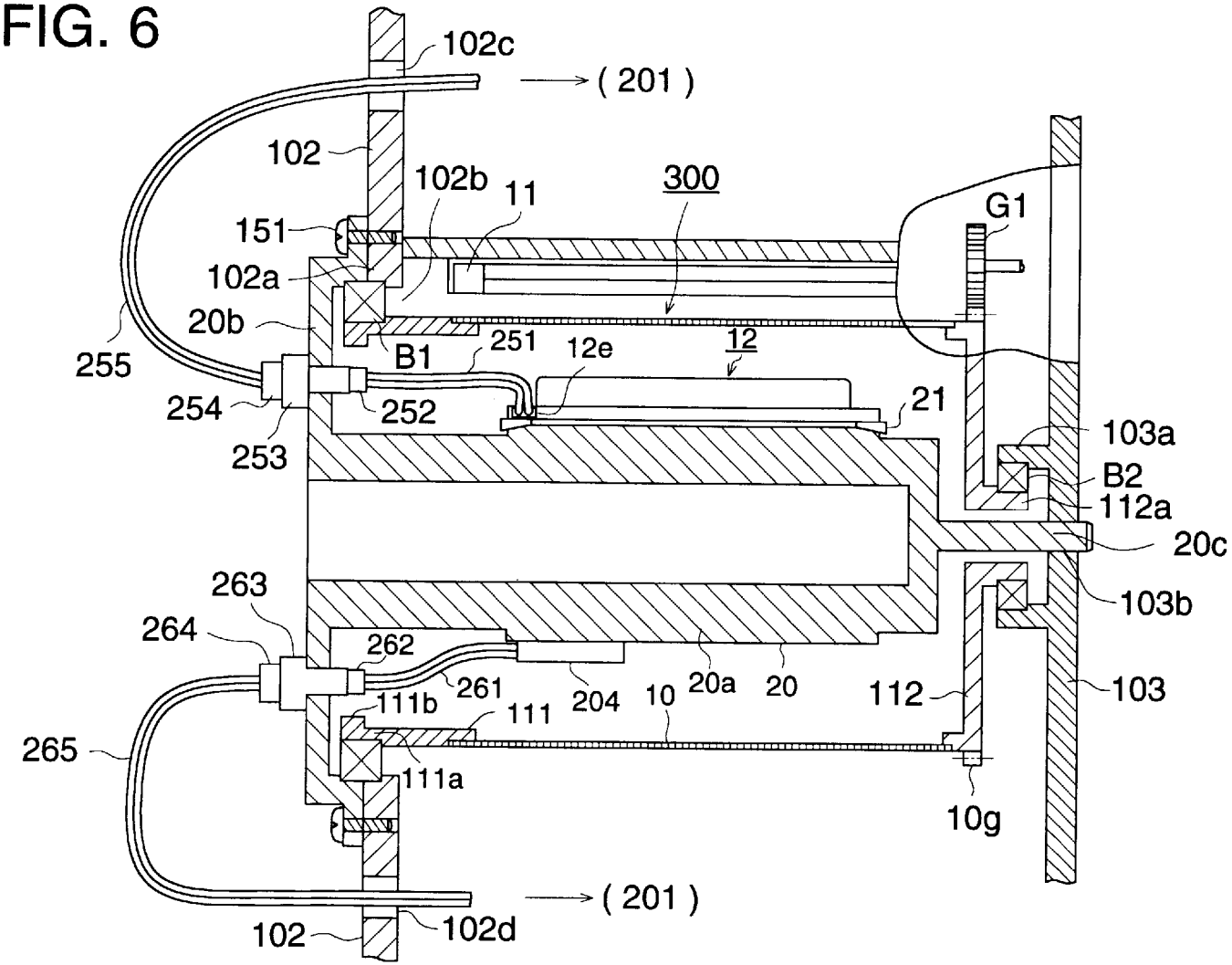
FIG. 6 is a sectional view showing a second example of a technique to mount a photoreceptor drum onto a casing.
Figure 7:
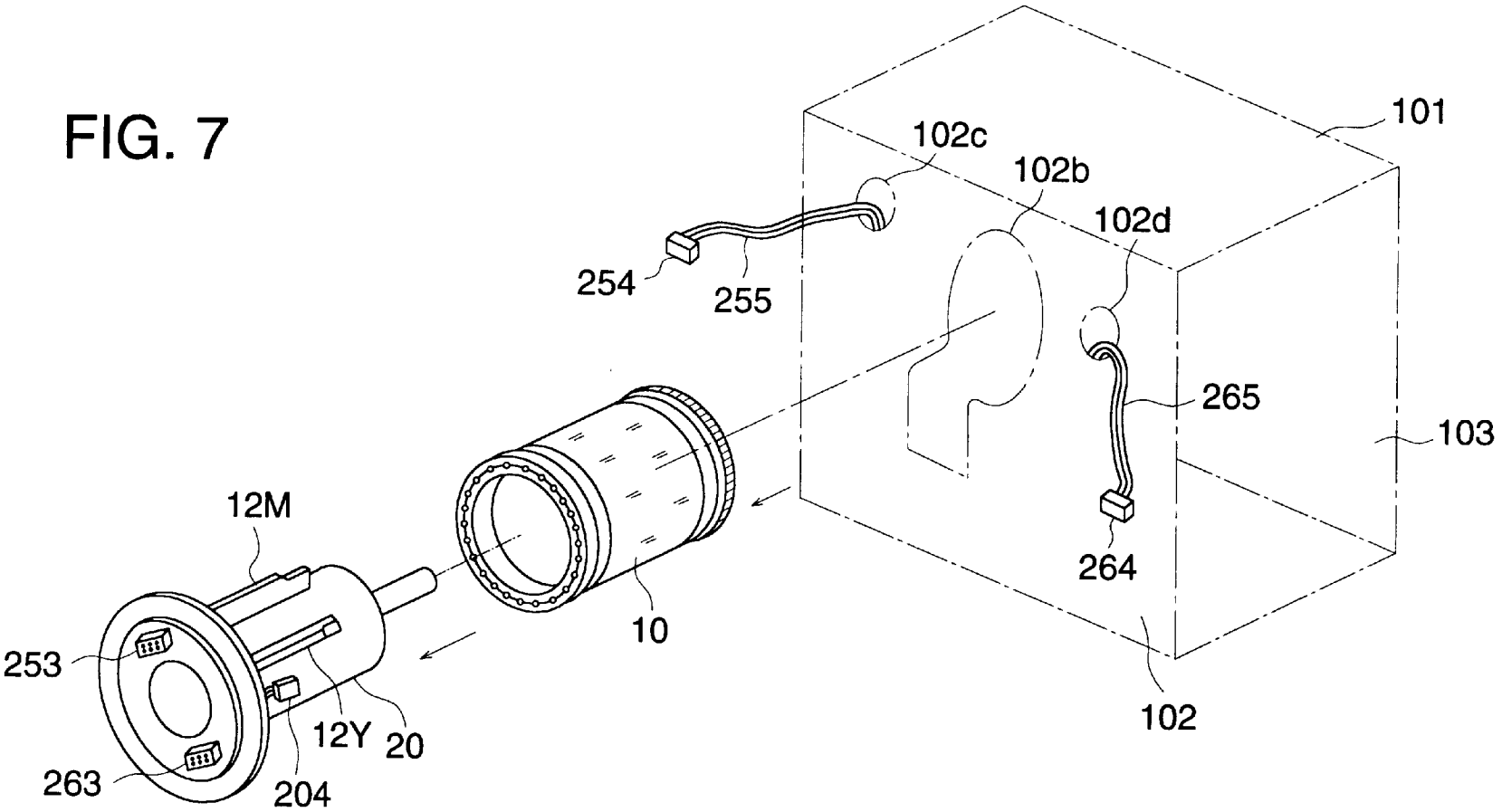
FIG. 7 is a illustration showing an outline of the assembling way for the structure in FIG. 6.

In the second embodiment of the present invention with regard to lead wire arrangement, another example will be explained with reference to FIG. 6, FIG. 7 and FIG. 3. FIG. 6 shows a sectional structural view showing the second example of the attaching method onto a casing of the image forming member, and FIG. 7 is a illustration showing an outline of the assembling manner.

A scorotron charging device 11, a developing device 13, and a cleaning device 100 which are the principal structure for an abovementioned image forming process as explained in FIG. 1 are mounted on front and rear plates 102 and 103 which construct a casing 101 in the apparatus main body. A photoreceptor drum 10 explained later on and the supporting member 20 are mounted in the casing 101, and thereafter, an intermediate transfer belt 14 is also inserted in the casing 101. The intermediate transfer belt 14 is inserted on the condition that it is separated from the photoreceptor drum 10, and the intermediate transfer belt 14 is brought in pressure contact with the photoreceptor drum 10 after being inserted in the casing 101. A bearing B2 shown in FIG. 6 is fit with pressure into a receiving section 103*a* of the rear plate 103.

The photoreceptor drum 10 is supported by being sandwiched between a rear flange 112 on the end of which a photoreceptor drum driving gear 10 is provided and a front flange 111 in which a bearing B1 is inserted with pressure into a receiving section 111*a*.

The photoreceptor drum 10 provided with the front and rear flanges 111 and 112 are inserted through a hole 102*b* of the front plate 102 into the casing 101, the outer periphery of a receiving section 112*a* of the rear flange 112 is fit with a bearing B2, and further a half portion of a bearing B1 which was previously fit with pressure into the front flange 111 is fit with pressure into a receiving section 102*a* of the front plate 102, whereby the photoreceptor drum 10 is mounted in the casing 101.

A supporting shaft 20*c* of a supporting member 20 on which plural exposure optical systems 12 for plural colors, transfer-simultaneous exposing device 12*g*, a sensor 12*f* and ROM(2) 204 are mounted is inserted into a shaft hole 103*b* on the rear plate 103 and a flange section of the supporting member 20*b* is fit into a remaining half portion of the bearing E1. On the condition that the exposure optical system 12 of each color is disposed at a proper position, the supporting member 20 is fixed to the front and rear plates 102 and 103 by fixing the flange section 20*b* to the front plate 102 with screws 151.

The gear 10*g* provided on the rear flange 112 is engaged with gear G1. Accordingly, the gear 10 is rotated by the gear G1 which is driven and rotated by unillustrated photoreceptor drum-driving motor provided in the apparatus body, whereby the photoreceptor drum 10 is rotated.

A connector 252 provided at a tip end of a lead wire 255 extended from a latermentioned control section 201 in the apparatus body is coupled with a relay terminal 253 with which a lead wire 251 extended from LED 121 of the exposure optical system 12 of each color, the transfer-simultaneous exposing device 12*g* and a light detection sensor 12*f* is coupled. Further, a connector 254 of a lead wire 265 extended from the control section 201 in the apparatus body is coupled with a relay terminal 263 with which a lead wire 261 extended from ROM(2) is coupled. The lead wires 255 and 256 are drawn out from the inside of the casing 101 to the outside through lead wire drawing-out holes 102*c* and 102*d* provided on the front plate 102.

When the photoreceptor drum 10 is replaced with a spare one, connectors 254 and 264 connected with the lead wires 255 and 265 are removed from the relay terminals 253 and 263, and then the screws 151 are removed. Then, by pushing the back end of the shaft 20*c* of the supporting member 20, the supporting member 20 can be drawn out from the hole 102*a* of the front plate 102. Thereafter, the photoreceptor drum 10 is drawn out by hooking an unillustrated special tool with a collar 111*b* provided on an inner circumference of the front flange 111, thereby replacing the photoreceptor drum 10 with a spare one.

With the abovementioned manner, the photoreceptor drum 10 and the supporting member are assembled and mounted.

Figure 8:
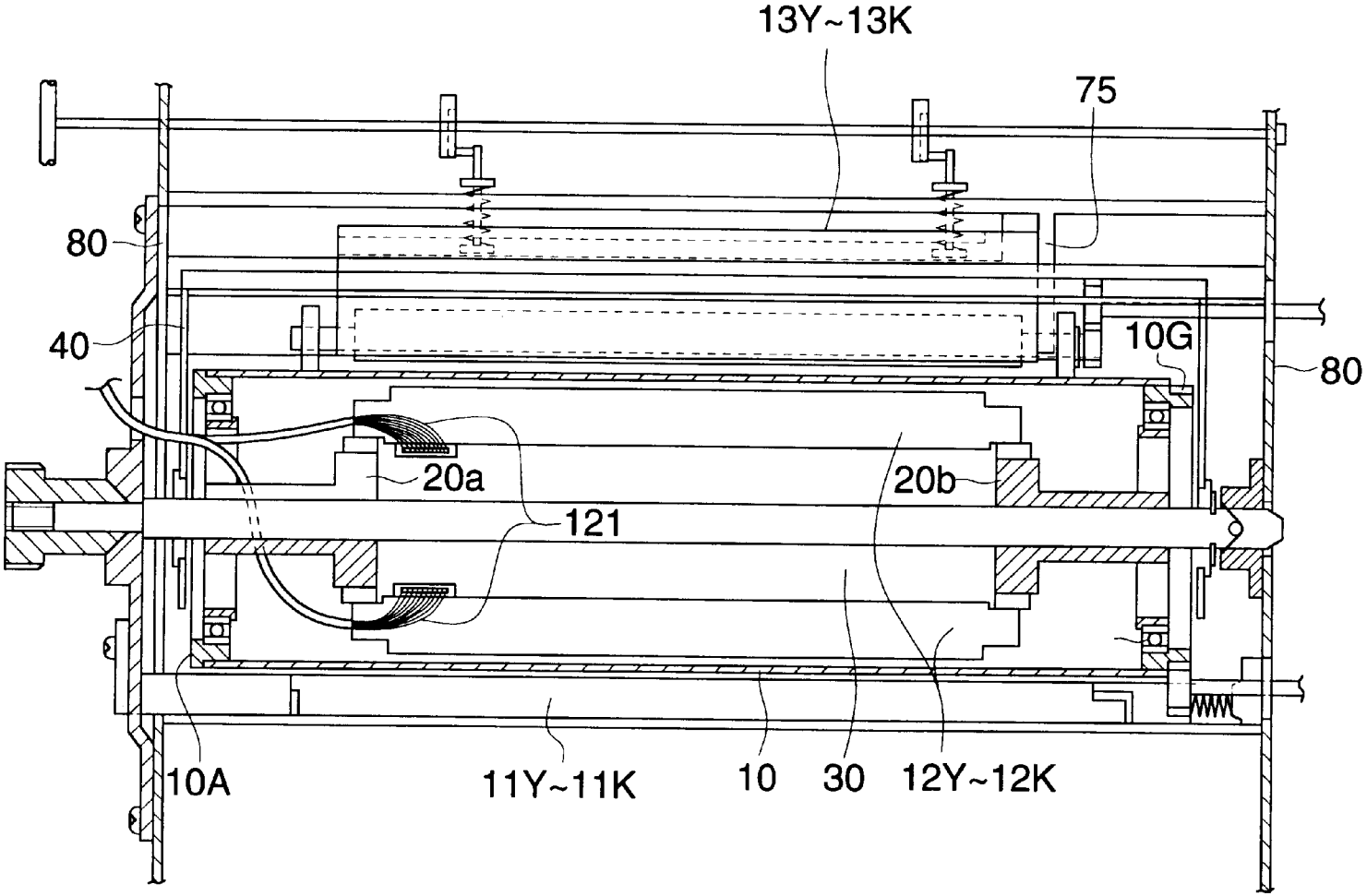
FIG. 8 is a sectional view in an axial direction showing an example of a mounting construction for a photoreceptor drum.

A basic structure of the second embodiment with regard to lead wire arrangement is explained with reference to FIG. 8.

In a wiring arrangement for imagewise exposure means 12Y to 12K of an exposure unit, electric cables 121 connected through connector with the imagewise exposure means 12Y to 12K is drawn out of a photoreceptor drum 10 through molding holes of supporting member 20*a* and 20*b* of an optical system supporting means 30 and a center hole of a flange 10A of the photoreceptor drum. Further, the electric cables are drawn out of the front plate 38 through a cut-out section 40A of a plate section of a U-shaped drum support 40 and are connected by a connector with wires of signal lines and power source line at the outside of the front plate 38. With this manner, by drawing out a great number of wires from the front side of the apparatus body from which the photoreceptor drum is inserted into the apparatus body, the wiring arrangement can be prevented from becoming complicate in the inner side on the rear plate, whereby it becomes easy to arrange a driving system of the photoreceptor drum 10 and developing devices 13Y to 13K. Further, in the time of mounting or dismounting the photoreceptor drum 10, since the electric cables are located at the front side, it can be conducted surely to connect or disconnect the wiring cables or it becomes possible to mount or dismount the photoreceptor drum 10 with the connected wiring cables.

A concrete structure of the second embodiment with regard to lead wire arrangement is explained with reference to FIGS. 9 to 13.

Figure 10:
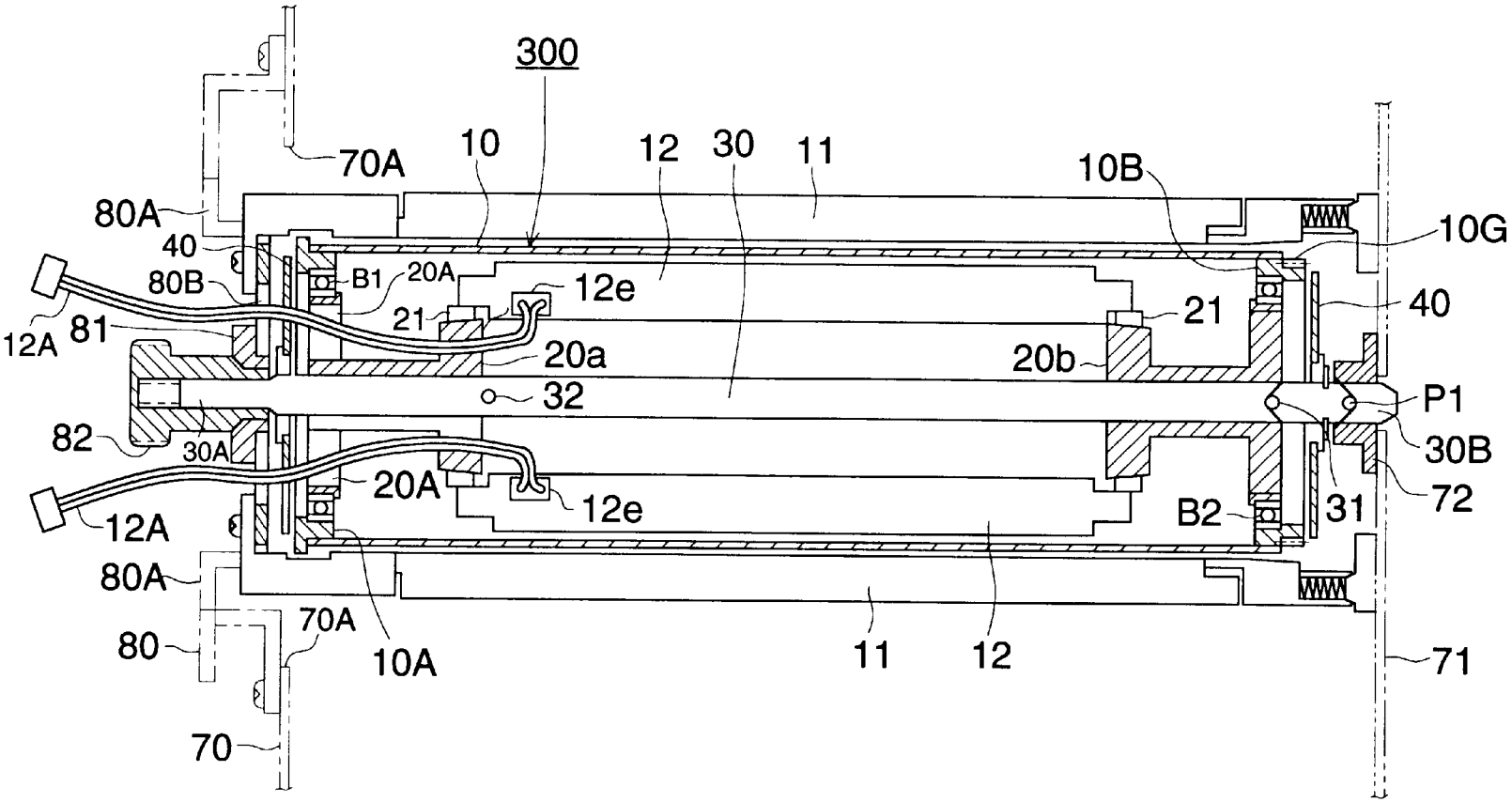
FIG. 10 is a sectional view showing a supporting construction for a photoreceptor drum.
Figure 11:
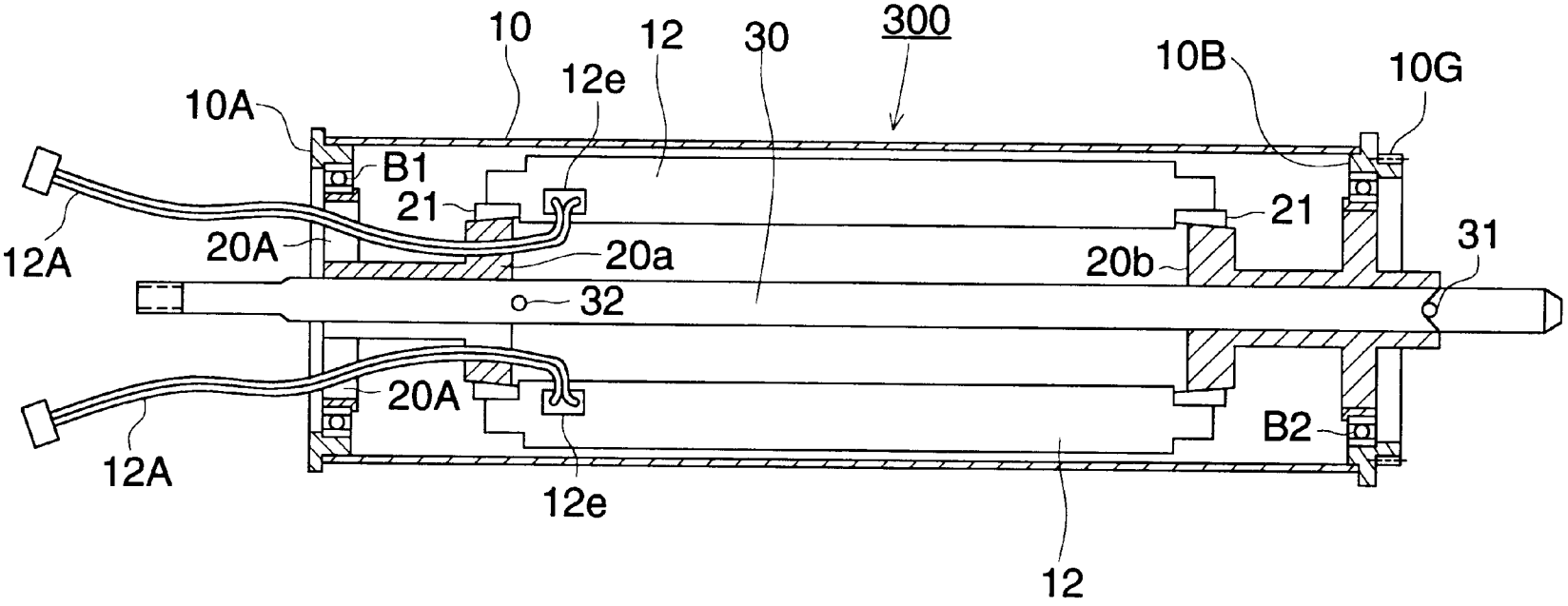
FIG. 11 is a sectional view of the photoreceptor drum.

As depicted in FIGS. 10 and 11, each exposure unit 12 is mounted on supporting members 20*a* and 20*b* which is provided as an exposure unit supporting means and is located right and left in the drawings, and the exposure units 12 mounted on the supporting member 20*a* and 20*b* are accommodated in the base body of the photoreceptor drum 10. Lead wires 12 of LED 121 provided on the exposure units 12 are withdrawn from window sections 20A of the supporting member 20*a* at the front side (the left side in FIG. 10) to the out side.

In FIG. 11, a reference numeral 300 is a drum unit as an image forming member unit or a photoreceptor drum unit. The drum unit is assembled in the following manner.

The supporting member 20*a* and 20*b* are constructed by a pair of right and left members which support the both ends of each exposure unit 12, and are mounted on a supporting shaft 30 forming a center axis. The both ends of each exposure unit 12 are mounted and fixed on the outer periphery of the supporting members 20*a* and 20*b*. A right side pin 31 is planted on a predetermined position on the supporting shaft 30. After the exposure unit 12 is mounted on the supporting shaft 30, A V-shaped groove on a right side surface of the right side supporting member is brought in contact with the right side pin 31. Then, a left side pin 32 is planted at a predetermined position on the supporting shaft 30 and the right side surface of the supporting member 20*a* is brought in contact with the left side pin 32, whereby the position of the exposure units 12 in an axial direction is determined.

Incidentally, needless to say, if the supporting members 20*a* and 20*b* and the supporting shaft 30 are initially formed in one body, it is not necessary to conduct the above works.

Supporting sections of the supporting member 20*a* and 20*b* on which the both ends of the exposure units 12 are side surfaces of a true octagon-shaped pillar, and each of the side surfaces of the supporting member 20*a* and a corresponding side surface of the supporting member 20*b* are arranged so as to form coplanar on a surface plate.

The both ends of each exposure unit 12 is adjusted with a wedge by using a special tool so that a distance between each exposure unit 12 and the photoreceptor drum is made a predetermined distance. Thereafter, the exposure units 12 are fixed on the side surfaces of the true octagon-shaped pillar of the supporting members 20*a* and 20*b* with adhesive.

The photoreceptor drum 10 is mounted from one end of the exposure unit 12 along the center axis of the exposure unit 12 so that the exposure unit 12 which is fixed together with the supporting members 20*a* and 20*b* on the supporting shaft 30 is incorporated in the photoreceptor drum 10. The both ends of the supporting shaft 30 supporting the exposure unit 12 and the both ends of the photoreceptor drum are held by a special tool on the condition that the center axis of the exposure unit 12 is aligned with that of the photoreceptor drum 10.

The left end section of the supporting member 20*a* (the left end in the drawings) is shaped in a cylinder section which is coaxial with the supporting shaft 30. An inner ring of a ball bearing member B1 (position regulating member) is fit with pressure onto an external circumference of the cylinder section of the supporting member 20*a*. An outer ring of the ball bearing member B1 is fit with pressure into an inner circumference of the flange 10A. The flange 10A is fit with pressure into a inner circumference of the photoreceptor drum 10.

In the similar manner, the right end section of the supporting member 20*b* (the right end in the drawings) is shaped in a cylinder section which is coaxial with the supporting shaft 30. An inner ring of a ball bearing member B2 (position regulating member) is fit with pressure onto an external circumference of the cylinder section of the supporting member 20*b*. An outer ring of the ball bearing member B2 is fit with pressure into an inner circumference of the flange 10B. The flange 10B is fit with pressure into a inner circumference of the photoreceptor drum 10. Whereby the drum unit 300 as an image forming unit is assembled.

A lead wire 12 provided to each exposure unit 12 is drawn out side of the drum unit 300 from a connector 12*e* provided on an end of a metal casing of the exposure unit 12 at the supporting member 20*a*-side through a window section 20A provided on the supporting member 20*a*. Further, a lead wire 12B from a transfer-simultaneous exposure means and a light detecting means provided on the supporting members 20*a* and 20*b* as mentioned later on in FIG. 4 is drawn out side of the drum unit 300 from a connector 12*e* provided on an end of the supporting member 20*a* through a window section 20A provided on the supporting member 20*a*. The window sections 20A through which the lead wires 12A and 12B pass are sealed so as to prevent toner from entering inside the drum unit 300.

Figure 9:
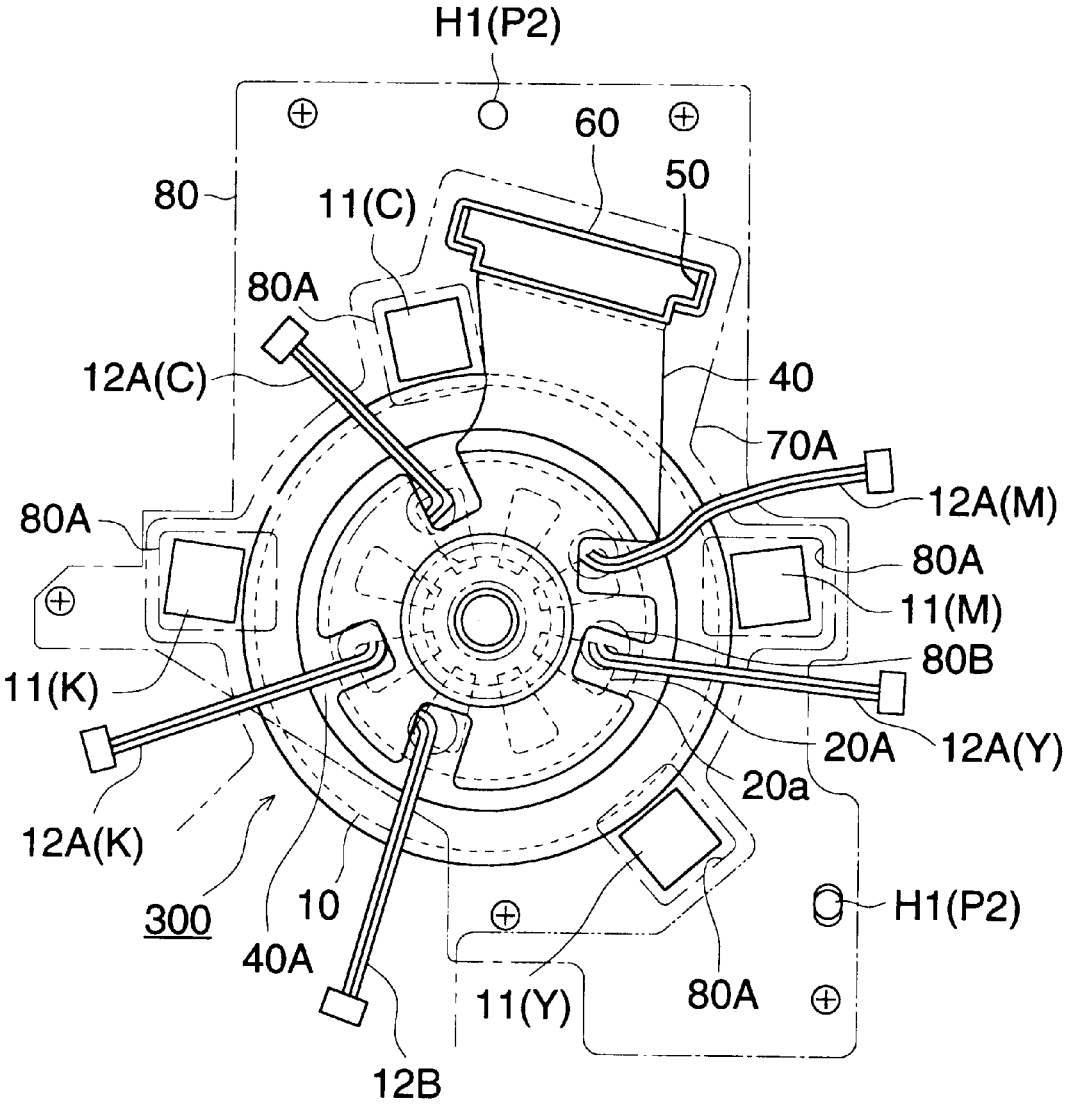
FIG. 9 is a front view showing a supporting construction for a photoreceptor drum.
Figure 13:
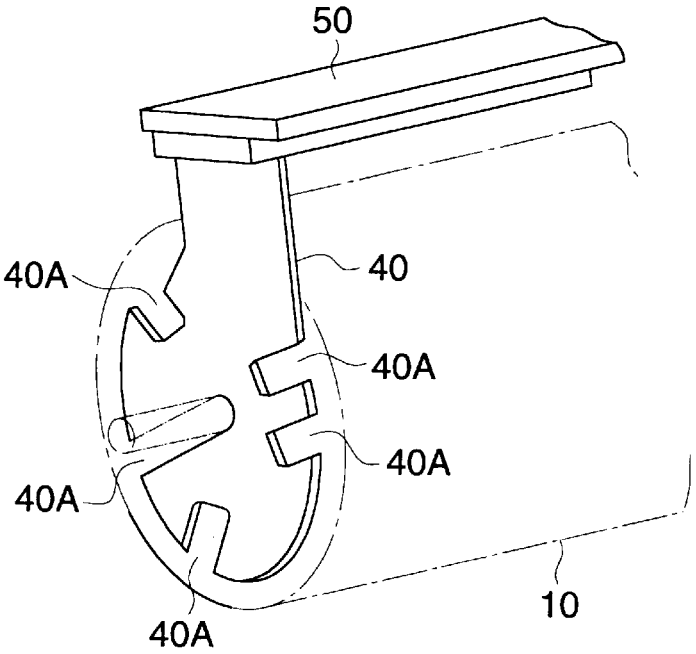
FIG. 13 is a view showing a lead wire draw-out section of a holding member for a photoreceptor drum.

As can be seen from FIGS. 9 and 13, flange 10A and 10B provided as end members on both ends of the photoreceptor drum 10 are rotatably supported around the supporting member 20 by the bearing B1 and B2. By driving gear 10G mounted on the flange 10B, the photoreceptor drum 10 is rotated around the supporting shaft 30 which is fixed as being stationary.

The photoreceptor drum 10 and the exposure units 12 are coaxially formed in one body as a drum unit 300 in which the supporting shaft forms a center of the unit. On the condition that the drum unit 300 is supported by the supporting shaft 30, the supporting shaft 30 is supported between drum-supporting plates 40 which are provided symmetrically at the front and rear sides, constructed in one body in a form of U, and work as holding members for the image forming unit and the image exposing means.

On the connecting section between the front and rear drum support plates 40 as the holding members, there is provided a rail member 50 made of a metal such as iron or aluminum working as a hanging means. By inserting the rail member 50 into a guide member provided on the apparatus body, the drum support plates 40 become a hung condition. As a result, the supporting shaft, that is, the photoreceptor drum 10 and the exposure units 12 are disposed at a predetermined setting position.

When the supporting shaft 30 is further inserted up to a regular position on the hung condition, a shaft end section 30B protruded from the rear drum support plate 40 is engaged with a receiving section 72 provided on a rear apparatus base plate 71 (a plate at a right side in FIG. 5). On the other hand, a shaft end section 30A protruded from the front drum support plate 40 is supported by a screw member 82 which is fit in a tape form with a receiving section 81 provided on a drum unit mounting plate 80. Whereby a setting position of the photoreceptor drum 10 is precisely regulated at a proper position and the gear 10G is engaged with driving gear. Further, when a pin P1 which passes through the shaft end section 30B is brought in engagement with a V-shaped groove formed on the receiving section 72, an angle position of the exposure unit 12 in positional relationship to the apparatus body is precisely regulated in a predetermined angle position and fixed at it.

As stated above, a lead wire 12 provided to each exposure unit 12 is drawn out side of the drum unit 300 from a connector 12*e* provided on an end of a metal casing of the exposure unit 12 at the supporting member 20*a*-side through a window section 20A provided on the supporting member 20*a* as explained in FIGS. 2 and 3. Further, a lead wire 12B from a transfer-simultaneous exposure means and a light detecting means provided on the supporting members 20*a* and 20*b* is drawn out side of the drum unit 300 from a connector 12*e* provided on an end of the supporting member 20*a* through a window section 20A provided on the supporting member 20*a*. The window sections 20A through which the lead wires 12A and 12B pass are sealed so as to prevent toner from entering inside the drum unit 300.

On the front drum support plate 40, a plurality of cut-out sections 40A are provided in correspondence with the lead wires 12A of each color and the lead wire 12B. Also, on the apparatus base plate 80, a plurality of through holes 80B are provided in correspondence with the lead wires 12A of each color and the lead wire 12B.

In correspondence with the lead wires 12A, the positions of the window 20A, the cut-out section 40A and the through hole 80B are registered at the same phase for each color, In correspondence with the lead wire 12B, the positions of the window 20A, the cut-out section 40A and the through hole 80 are registered at the same phase.

Figure 12:
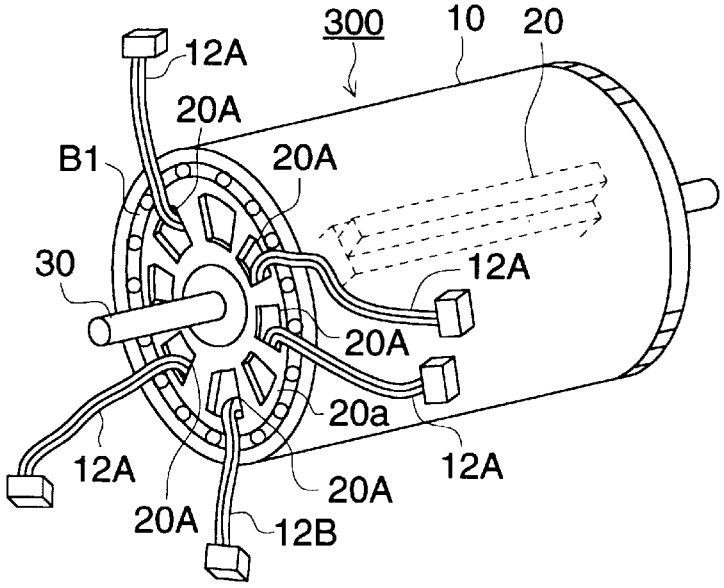
FIG. 12 is a perspective view showing a way to draw lead wires from the photoreceptor drum.

A lead wire 12 of Y, M, C, and K of LED 121 provided to each exposure unit 12 is drawn outside of the drum unit 300 from a connector 12*e* provided respectively on an end of a metal casing of the exposure unit 12 at the supporting member 20*a*-side through a window section 20A provided on the supporting member 20*a* at the front side (the left side in FIGS. 10 and 12. Further, a lead wire 12A of each color is withdrawn from a window 20 through a cut-out section 40A on the drum support plate 40 and a through hole 80B on a drum unit mounting plate 80 and is connected with power source section. The lead wire 12 is also withdrawn and connected with an electric circuit. As stated above, the window sections 20A through which the lead wires 12A of each color of Y, M, C, and K and 12B pass are sealed so as to prevent toner from entering inside the drum unit 300. Incidentally, the cut-out section 40A may be formed by a hole or the through hole 80B may be formed by a cut-out section.

With the above structure, the lead wires are drawn outside of the supporting member without loading a weight on the exposure units so that the exposure units may not be deformed. Further, through the cut-out sections on a drum support plate and the holes on the apparatus base plate which are registered at the same phase, the lead wires are drawn outside of the drum unit without loading a weight onto the exposure unit so that the deformation of the exposure unit can be avoided. Further, by arranging the connectors on the end section of the exposure unit at the window side of the supporting member, the deformation of the exposure unit caused by the weight of the lead wire can be avoided.

A mounting position of the drum unit mounting plate 80 is determined by engaging upper and lower reference holes H1 with upper and lower reference pin P2 provided on a front apparatus base plate 70, and fixed on the front apparatus base plate 70 with screws at several points. Further, plural windows 80A are provided on the drum unit mounting plate 80 and a bar-shaped scorotron charging devices 11 are inserted from the outside of the drum unit mounting plate 80 into the apparatus through the plural windows 80A. Then, the bar-shaped scorotron charging devices 11 are set at predetermined positions with a proper gap distance to the photoreceptor drum 10 and are fixed with screws on the condition that an electrodes are connected at an operating position.

Accordingly, on the condition that the scorotron charging devices 11 are dismounted through the windows 80A, after the screws 82 is removed, the drum unit mounting plate 80 is dismounted from the front apparatus base plate 70 by removing the screws on the several points.

Successively, from the above condition, the drum support plate 40 can be drawn by sliding the rail member with the guide of the guiding member 60. The drum unit in which the photoreceptor drum 10 and the exposure units 12 are made in one body is moved in a horizontal direction and can be drawn outside of the apparatus body through the hole 70 on the front apparatus base plate 70.

In advance to start the mounting or dismounting operation for the photoreceptor drum 10 supported by the drum support plate 40 onto or from the apparatus body, an intermediate transfer belt and cleaning device 100 which are provided around the periphery of the photoreceptor drum 10 are released from a pressure contacting operation and are located at a separated position with a gap of 1 to 10 mm. Also, the developing devices 13 which are provided around the periphery of the photoreceptor drum 10 are located on a separated position with a gap of 30 to 50 mm. From the separated position, the developing devices can be drawn out in the same direction as that of the photoreceptor drum 10. After, the photoreceptor drum 10 is mounted at the working position, the developing devices are brought in pressure contact with the photoreceptor drum 10.

Now, the structure of an intermediate transfer belt will be explained.

Figure 14:
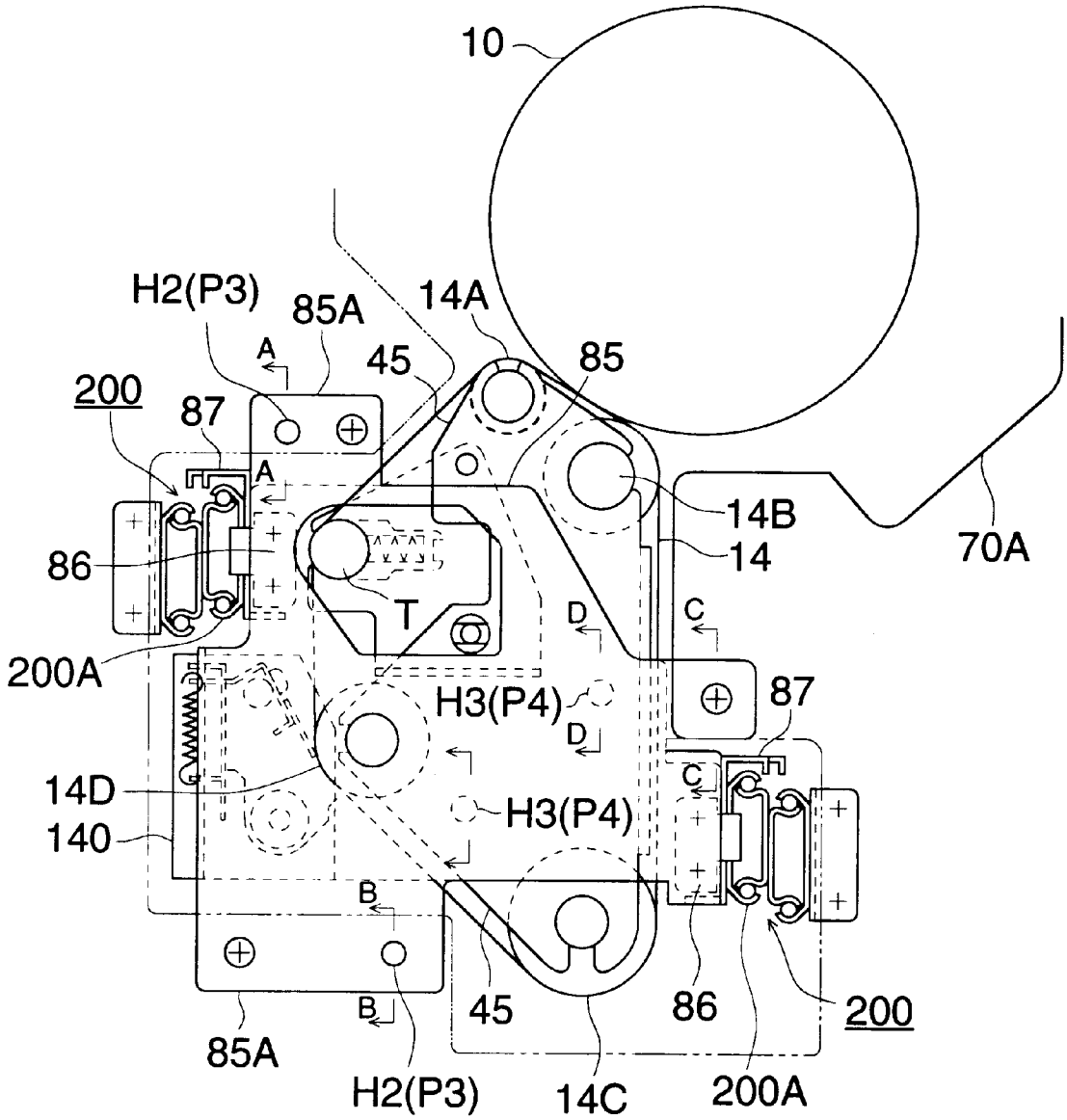
FIG. 14 is a front view showing a supporting construction for an intermediate transfer belt.
Figure 15:
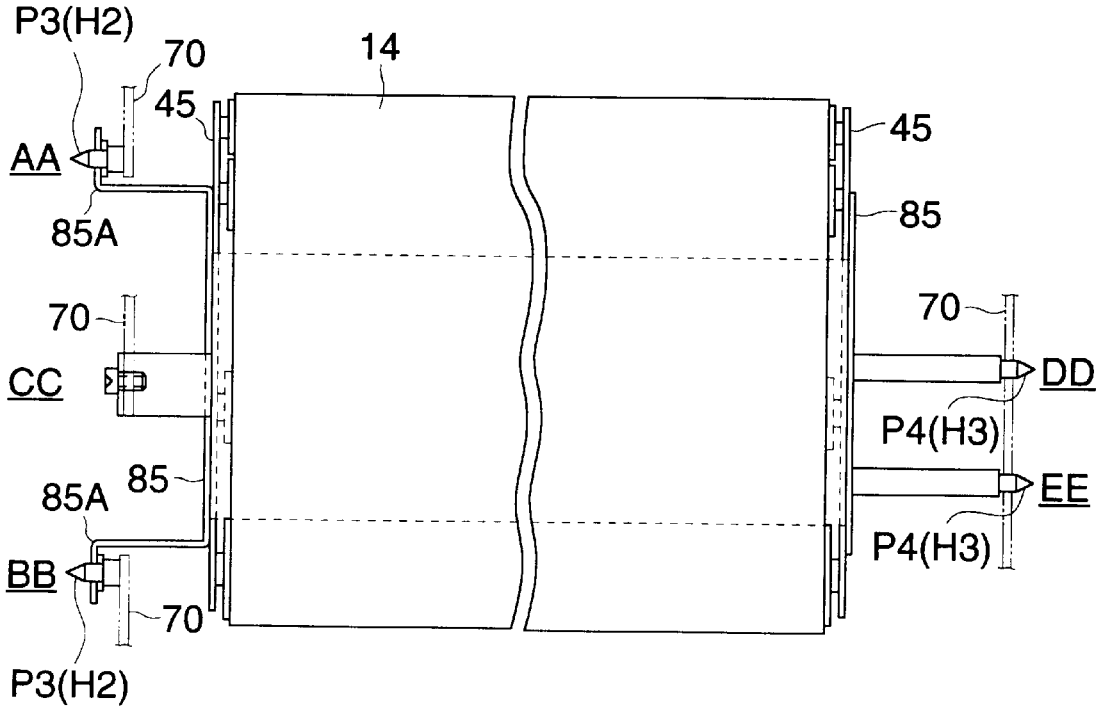
FIG. 15 is a sectional view showing a supporting construction for an intermediate transfer belt.

In FIGS. 14 and 15, rollers 14A through 14D are supported with bearings between front and rear belt support plates 45 which are constructed in one body in a shape of U, and a intermediate transfer belt is stretched around the rollers 14A through 14D with tension force by a tension roller T.

The belt support plates 45 is supported together with an intermediate transfer belt cleaning device 140 between front and rear belt support base plates 85A and 85B which are asymmetrically constructed in one body in a shape of U.

Reference holes H2 used as hanging means are provided on a front apparatus base plate 70 and reference holes H3 are provided on a rear apparatus base plate 71. On the hand, the front belt support base plate 85A are provided with pin P3 and the rear belt support base plate 85B are provided with pin P4. After the pin P3 and P4 are engaged with the reference holes H2 and H4, the front and rear belt support plates 85A and 85B are fixed to the front and rear apparatus base plates 70 and 71 with screws so that the intermediate transfer belt 14 is set at a predetermined working position. In such the working position, the intermediate transfer belt 14 comes in contact with the circumference of the photoreceptor drum 10 and forms the first transfer section at which a toner image is transferred from the photoreceptor drum 10 to the intermediate transfer belt 14. Further, the intermediate transfer belt 14 comes in contact with a transfer roller 15 and forms a second transfer section at which the toner image is transferred from the intermediate transfer belt 14 to a transfer sheet.

The front and rear belt support base plates 85A and 85B are provided with arcuride-rail (trade name) which is a pair of guide rails retractable in two stages so that the front and rear belt support base plates 85A and 85B can be drawn out to the front side of the apparatus body.

The front and rear belt support base plates 85A and 85B are provided with front and rear guide plates 86 at their left and right sides. The guide plates 86 hold slidable sections 200A of the guide rails 200 in such a manner that the guide plates 86 are slidable in a vertical direction along the side of the slidable sections 200A. Accordingly, when the front and rear belt support base plates 85A and 85B are drawn out, the guide plates 86 are moved together with the slidable sections 200A as one body. However, in the vertical direction, the guide plates 86 are slidable until the stoppers 87 come in contact with the slidable sections 200A.

When the front and rear belt support base plates 85A and 85B are slightly drawn out toward the front side of the apparatus body after the screws are removed, the pins P3 and P4 are disengaged from the reference holes H2 and H4 so that the front and rear belt support base plates 85A and 85B can be lowered until the stoppers 87 come in contact with the slidable sections 200A. On the condition that the stoppers 87 ride on the slidable sections 200A, by extending the guide rails 200, the front and rear belt support base plates 85A and 85B can be drawn out through opening section 70A of the front apparatus base plate 70. As a result, on the condition that the intermediate transfer belt 14 is released from the pressure contact and spaced from the circumference of the photoreceptor drum 10, the intermediate transfer belt 14 is drawn out.

When the intermediate transfer belt 14 is mounted again, by pushing the guide rails 200 to the retracted position, the front and rear belt support base plates 85A and 85B are mounted in the apparatus body. By lifting up the front and rear belt support base plates 85A and 85B, the pins P3 and P4 are engaged with the reference holes H2 and H4. As shown in FIG. 15, the pins P3 and P4 are tapered so that when the front and rear belt support base plates 85A and 85B are further moved inside, the front and rear belt support base plates 85A and 85B can be moved upward with the guide of the taper of the pins P3 so that the intermediate belt 14 can be returned to pressure contact with the photoreceptor drum 10.

As can be seen from the above description, by the simple operation to dismount the front and rear belt support base plates 85A and 85B, the photoreceptor drum 10 becomes in the condition that the photoreceptor drum 10 can be drawn out without interfering with the intermediate transfer belt 14. Further, by drawing out the front and rear belt support base plates 85A and 85B, the drum unit 300 can be drawn out, a sheet jammed on the sheet passage can be removed, the intermediate transfer belt 14 can be replaced with a spare one, and the internal inspection and the maintenance can be conducted.

Incidentally, in advance to the operation to draw out the front and rear belt support base plates 85A and 85B from the apparatus body, the roller 14C in the intermediate transfer belt 14 is released from the pressure contact with the transfer roller 15. When the front and rear belt support base plates 85A and 85B are returned to the working position, the roller 14C is brought in pressure contact with the transfer belt 15.

Needless to say, the embodiment with regard to lead wire arrangement can be conducted by transferring directly a toner image from the photoreceptor drum 10 to a sheet member without using the intermediate transfer belt means.

Next, in the above embodiments, a preferable driving mechanism for the photoreceptor drum and developing conveying rollers of a developing device is explained with reference to FIGS. 16 through 19.

Figure 16:
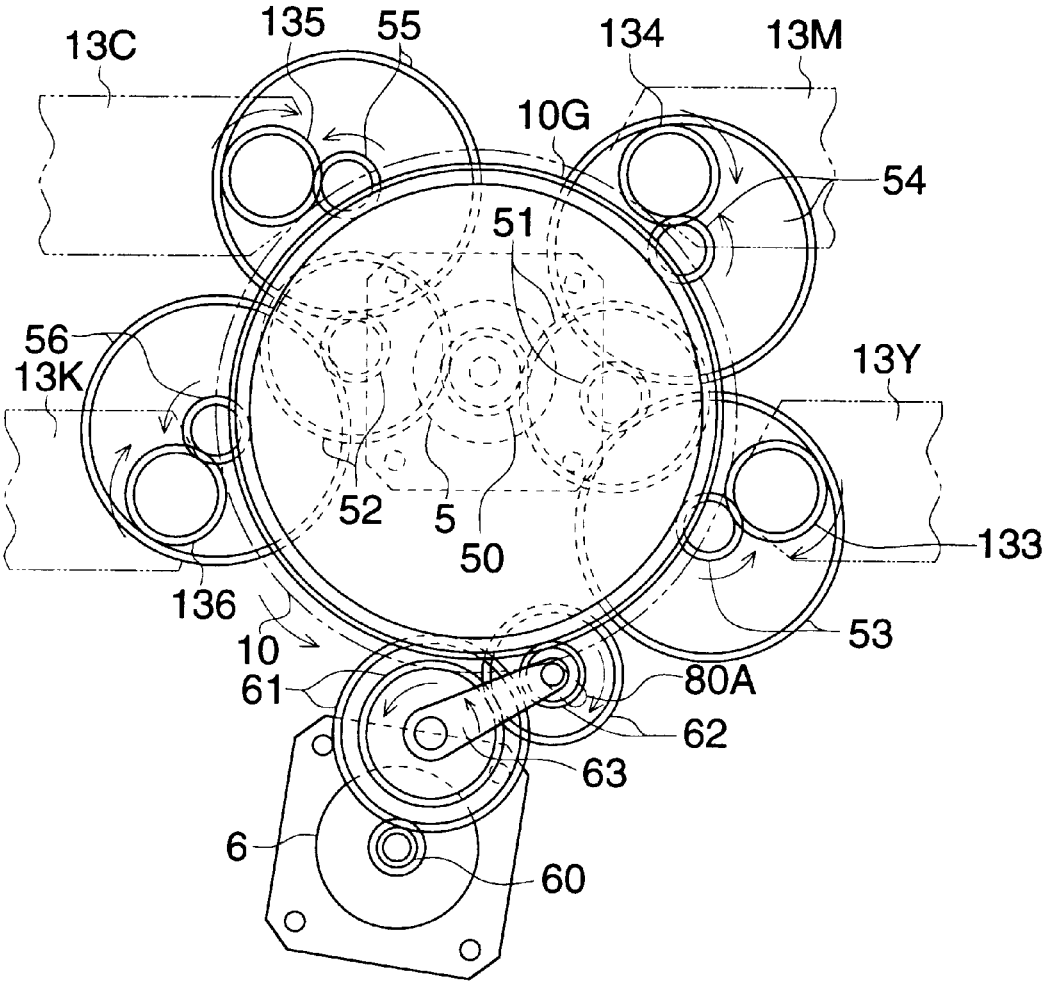
FIG. 16 is a partial view showing an example of a driving mechanism for a photoreceptor drum and a developer layer conveying roller.
Figure 17:
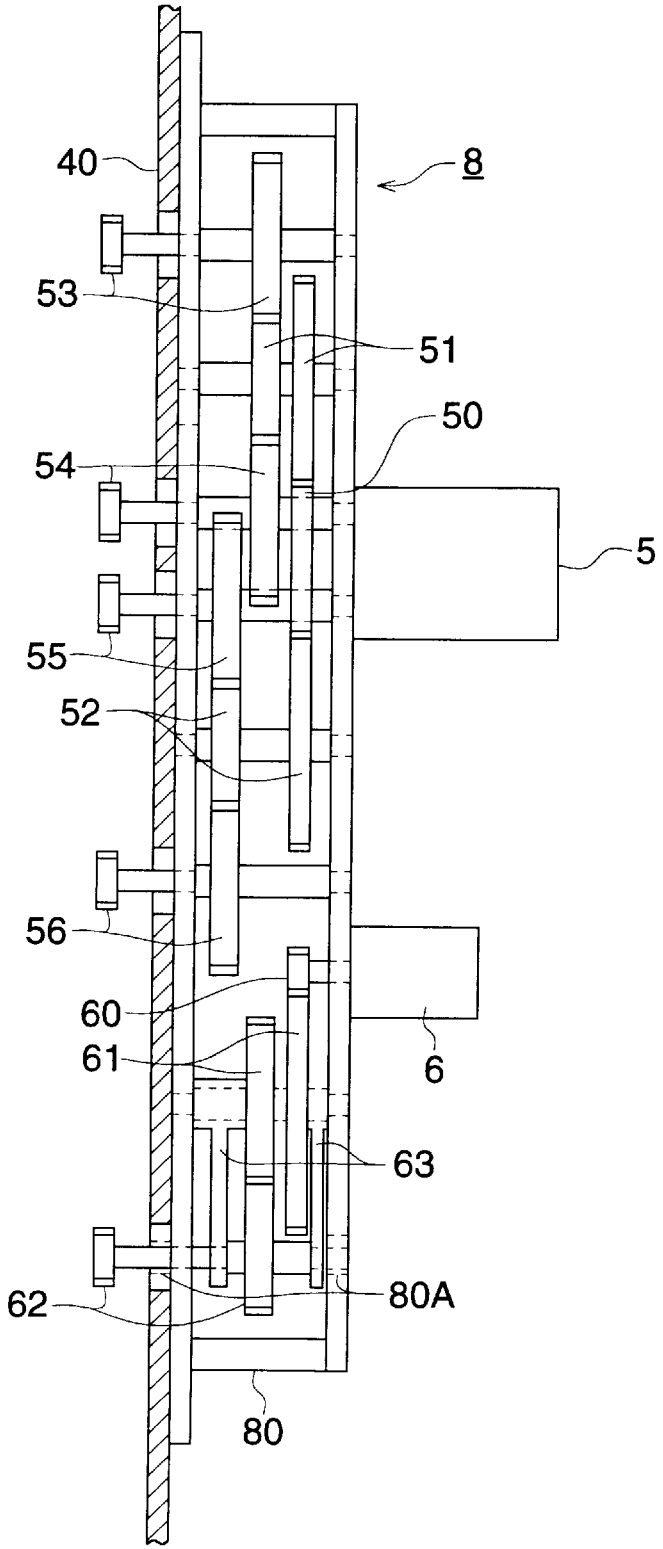
FIG. 17 is a sectional view showing a driving unit for a photoreceptor drum and a developer layer conveying roller.

In the color image forming apparatus in FIGS. 16 and 17, branch reduction gears 51 and 52 are engaged with a motor gear 50 on the motor 50 which is located at a position almost corresponding to the center of the photoreceptor drum 10. Relay reduction gears 53 and 54 are engaged with the branch reduction gear 51 and relay reduction gears 55 and 56 are engaged with the branch reduction gear 52. Sleeve gears 133, 134, 135 and 136 of the developing sleeves 130 of the developing devices 13Y to 13K are engaged with the relay reduction gears 53, 54, 55 and 56. Whereby the sleeve gears 133, 134, 135 and 136 are driven through the branch reduction gears 51 and 52 and the relay reduction gears 53, 54, 55 and 56 by the motor 5 in such a manner that the developing sleeves 130 are rotated so as to be pressed against the photoreceptor drum 10. With the pressing force, the developing sleeve 130 can maintain a proper gap for the photoreceptor drum 10 without deviation. Further, through the four sets of gear trains which are relatively short and have the same trains, the rotation is transmitted smoothly from the motor gear 50, a color image with good color balance can easily formed and the apparatus can be constructed in compact and at low cost.

Incidentally, it may be preferable to use slanted gears as the sleeve gears 133 to 136 and the relay reduction gears 53 to 56 which are engaged with the sleeve gears 133 to 136. Because, when the developing sleeves are rotated in the direction shown in FIGS. 1 and 16, the slanted gears create a component force in the axial direction in which the developing devices are pressed toward the engaging guide 75 in FIG. 8, whereby the positions of the developing devices 13Y to 13K become stable.

A driving gear 62 to rotate the photoreceptor drum 10 is a reduction gear driven through a carrier reduction gear 61 by a motor gear 60 of the motor 6 which is located farther from a center of the photoreceptor drum 10, that is, on a peripheral section of the photoreceptor drum 10. Since the rotation is transmitted from the motor gear through the short gear train to the photoreceptor drum 10, in the combination with the feature that the photoreceptor drum 10 is made rotatable relatively to the optical system supporting means 30, clear color image can be easily formed without color deviation and the apparatus can be constructed in compact and at low cost.

Incidentally, it may be preferable to use slanted gears as the drum gear 10G and the driving gear 62 which is engaged with the drum gear 10G. Because, when the photoreceptor drum 10 is rotated in the direction shown in FIGS. 1 and 16, the slanted gears create a component force in the axial direction with which a gear end ring 10B of the drum gear 10G and the bearing are prevented from slipping out, whereby the rotating position of the photoreceptor drum 10 become stable and the occurrence of color deviation may be avoided. Further, a direction of a component force of the driving gear 62 to rotate the photoreceptor drum 10 and a direction of a component force of the relay reduction gears 53 to 56 to rotate the developing sleeves are made the same direction depending on the engaging construction of the bearings, the gear end ring 10B and brackets 33 of the optical system supporting member 30, positional relationship among the photoreceptor drum 10 and the developing devices 13Y to 13K becomes more stable, whereby a clear color image can be formed more stably.

A rotating bracket 63 is rotatably engaged with a shaft of the carrier reduction gear 61. Since the driving gear 62 is supported with its bearing by the rotating bracket 63, when the motor 6 is rotated clockwise, the rotating bracket is rotated counterclockwise so that the driving gear 62 is engaged with the drum gear 10G and the photoreceptor drum 10 is rotated counterclockwise. On the other hand, when the motor 6 is rotated counterclockwise, the rotating bracket is rotated clockwise so that the driving gear 62 is disengaged with the drum gear 10G. Since the shaft of the driving gear 62 is inserted in a regulating groove 80A provided on a unit frame 80 of the driving unit 8, the rotating range of the rotating bracket 63 in the clockwise direction is limited when the shaft of the driving gear 62 comes in contact with the regulating groove 80A. On the condition that the driving gear 62 is disengaged with the drum gear 10G, the drum unit mounting plate 80 is dismounted from the front apparatus base plate 70 and the drum unit 300 can be drawn out from the apparatus body.

The driving means of the photoreceptor drum 10 and the developing sleeves of the developing devices 13Y to 13K are incorporated as one unit in the driving unit 8. Since the driving unit 8 is mounted on the outside of the rear apparatus base plate 71, an assembling work, a disassembling work and maintenance can be conducted easily.

Figure 18:
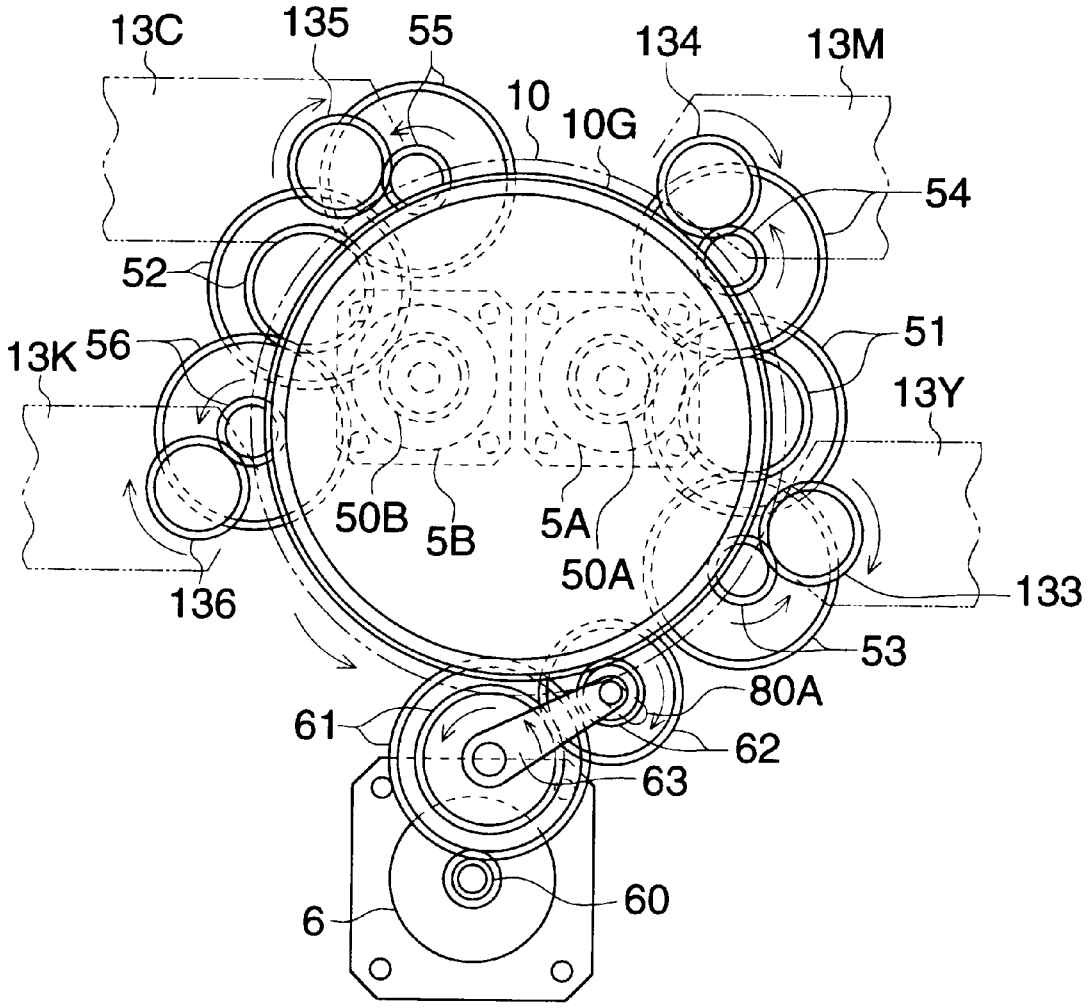
FIG. 18 is a partial view showing another example of a driving mechanism for a photoreceptor drum and a developer layer conveying roller.
Figure 19:
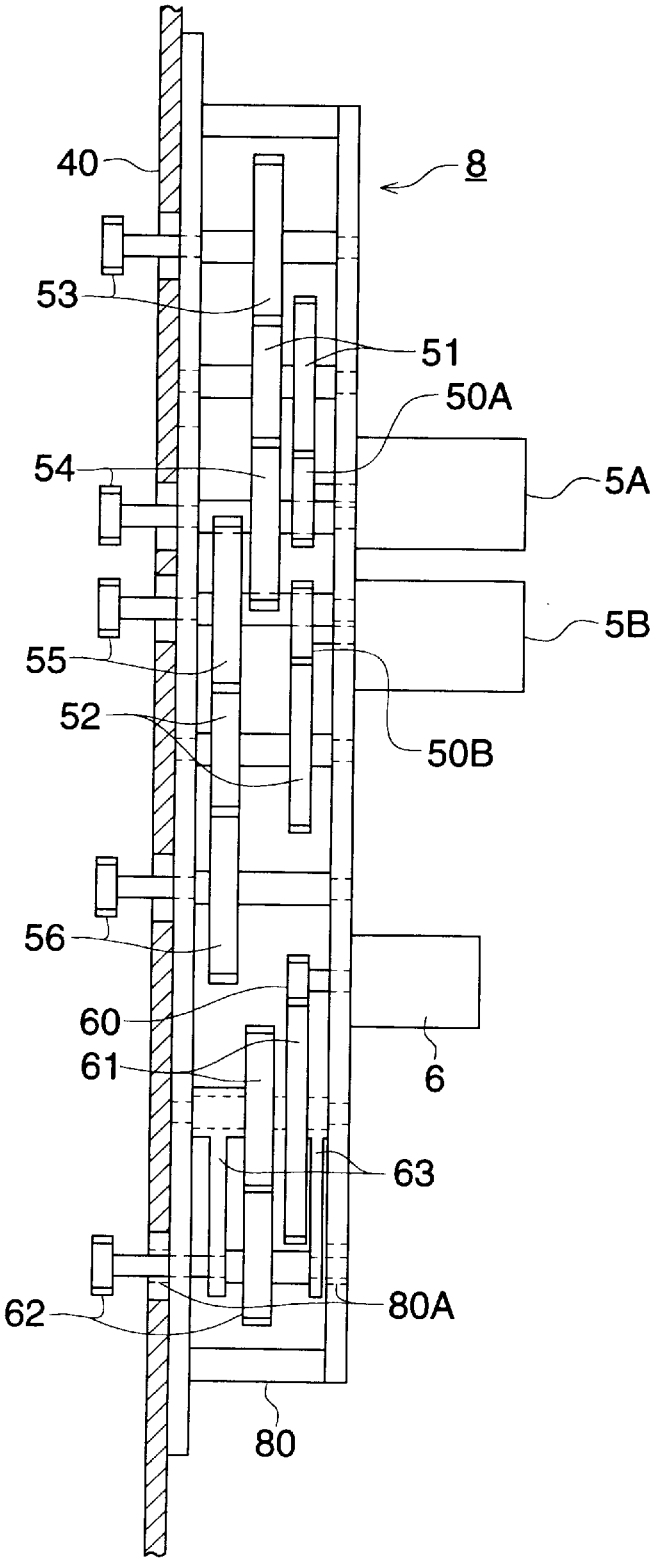
FIG. 19 is a sectional view showing a driving unit for a photoreceptor drum and a developer layer conveying roller.

In the embodiment shown in FIGS. 18 and 19, the following points are different from that in FIGS. 16 and 17.

Two sets of motor 5A and 5B are provided at right and left sides of the rotation center of the photoreceptor drum 10. The developing sleeves 130 of the developing devices 13C and 13K which are located the left side of a vertical line of the rotation center are driven by the motor 5B. On the other hand, the developing sleeves 130 of the developing devices 13M and 13Y which are located the right side of a vertical line of the rotation center are driven by the motor 5A. With the embodiment of FIGS. 18 and 19, the same effects as that in FIGS. 16 and 17 can be obtained.

As stated above, in the present invention, in a color image forming apparatus in which charging, image exposure, and developing are repeated on an outer circumferential surface of a rotatable drum-shaped image forming body so as to superimpose plural toner images so that a color image is formed on the outer circumferential surface, plural image exposing means are mounted on an optical system-supporting member, the image forming member is provided with a drum gear at its one end, the optical system-supporting member is accommodated inside the image forming member and fixed to a side plate of an apparatus body, the image forming member is engaged with the optical system-supporting member in such a manner that the image forming member is relatively rotatable around the optical system-supporting member, a motor to rotate the image forming member and a rotation transmission gear train are supported by the side plate, a driving gear of the rotation transmission gear train is brought in engagement with the drum gear by being pushed by the rotation of the motor, the driving gear and the drum gear are provided with inclined gear teeth or slanted gear teeth so that a component force of the driving gear in the axial direction is used to make a position of the image forming member stable.

In a color image forming apparatus in which charging, image exposure, and developing are repeated on an outer circumferential surface of a rotatable drum-shaped image forming body so as to superimpose plural toner images so that a color image is formed on the outer circumferential surface, a plurality of developing devices are provided on an outer circumferential surface of the image forming member in such a manner that a developing layer conveying roller is located close to the outer circumferential surface, a motor to rotate the developing layer conveying roller and a rotation transmission gear train are supported by the side plate, a gear of the developing layer conveying roller and a driving gear of the rotation transmission gear train are provided with inclined gear teeth or slanted gear teeth so that a component force of the driving gear in the axial direction is used to make a position of the developing devices stable.

In a color image forming apparatus in which charging, image exposure, and developing are repeated on an outer circumferential surface of a rotatable drum-shaped image forming body so as to superimpose plural toner images so that a color image is formed on the outer circumferential surface, plural image exposing means are mounted on an optical system-supporting member, the image forming member is provided with a drum gear at its one end, the optical system-supporting member is accommodated inside the image forming member and fixed to a side plate of an apparatus body, the image forming member is engaged with the optical system-supporting member in such a manner that the image forming member is relatively rotatable around the optical system-supporting member, a plurality of developing devices are provided on an outer circumferential surface of the image forming member in such a manner that a developing layer conveying roller is located close to the outer circumferential surface, a motor to rotate the image forming member, a motor to rotate the developing layer conveying roller and a rotation transmission gear train are supported by the side plate, a driving gear engaging with the drum gear and a driving engaging with a gear of the developing layer conveying roller are provided with inclined gear teeth or slanted gear teeth, component forced of these driving gears in the axial direction act in the same direction so that the component forces of these driving gears are used to make positions of the image forming member and the developing devices stable.

Four sets of image exposing means are mounted on an optical system-supporting member, the image forming member is provided with a drum gear at its one end, the optical system-supporting member is accommodated inside the image forming member and fixed to a side plate of an apparatus body, the image forming member is engaged with the optical system-supporting member in such a manner that the image forming member is relatively rotatable around the optical system-supporting member, tow sets of developing devices are provided at upper and lower positions on each right and left side of the vertical line passing through the rotation center of the image forming member in such a manner that a developing layer conveying roller is located close to the outer circumferential surface, a motor to rotate the image forming member is located on the periphery of the image forming member and a motor to rotate the developing layer conveying rollers of the four sets of developing devices is located in the vicinity of the center of the image forming member, these tow motors and rotation transmission gear trains are supported by the side plate.

Four sets of image exposing means are mounted on an optical system-supporting member, the image forming member is provided with a drum gear at its one end, the optical system-supporting member is accommodated inside the image forming member and fixed to a side plate of an apparatus body, the image forming member is engaged with the optical system-supporting member in such a manner that the image forming member is relatively rotatable around the optical system-supporting member, tow sets of developing devices are provided at upper and lower positions on each right and left side of the vertical line passing through the rotation center of the image forming member in such a manner that a developing layer conveying roller is located close to the outer circumferential surface, a motor to rotate the image forming member is located on the periphery of the image forming member and two set of motors to rotate the developing layer conveying rollers of the two sets of developing devices are located at right and left sides in the vicinity of the center of the image forming member, these three motors and rotation transmission gear trains are supported by the side plate.

In the invention, the drum gear 10G of the photoreceptor drum 10 may be constructed as a inside gear with which the same effects can be obtained.

In a color image forming apparatus, a positional relationship accuracy among the photoreceptor drum and a plurality of image exposing means are maintained correctly stably and the developing sleeves of a plurality of developing devices to convey the developing layer is rotated smoothly at a predetermined speed while maintaining a predetermined gap among the developing sleeves and the photoreceptor drum, whereby a clear color image can be formed easily without color deviation. Further, since the photoreceptor drum can be easily engaged with or disengaged from the driving system, maintenance such as replacement of the photoreceptor drum can be conducted easily and the configuration of the apparatus can be made in compact.

Figure 20:
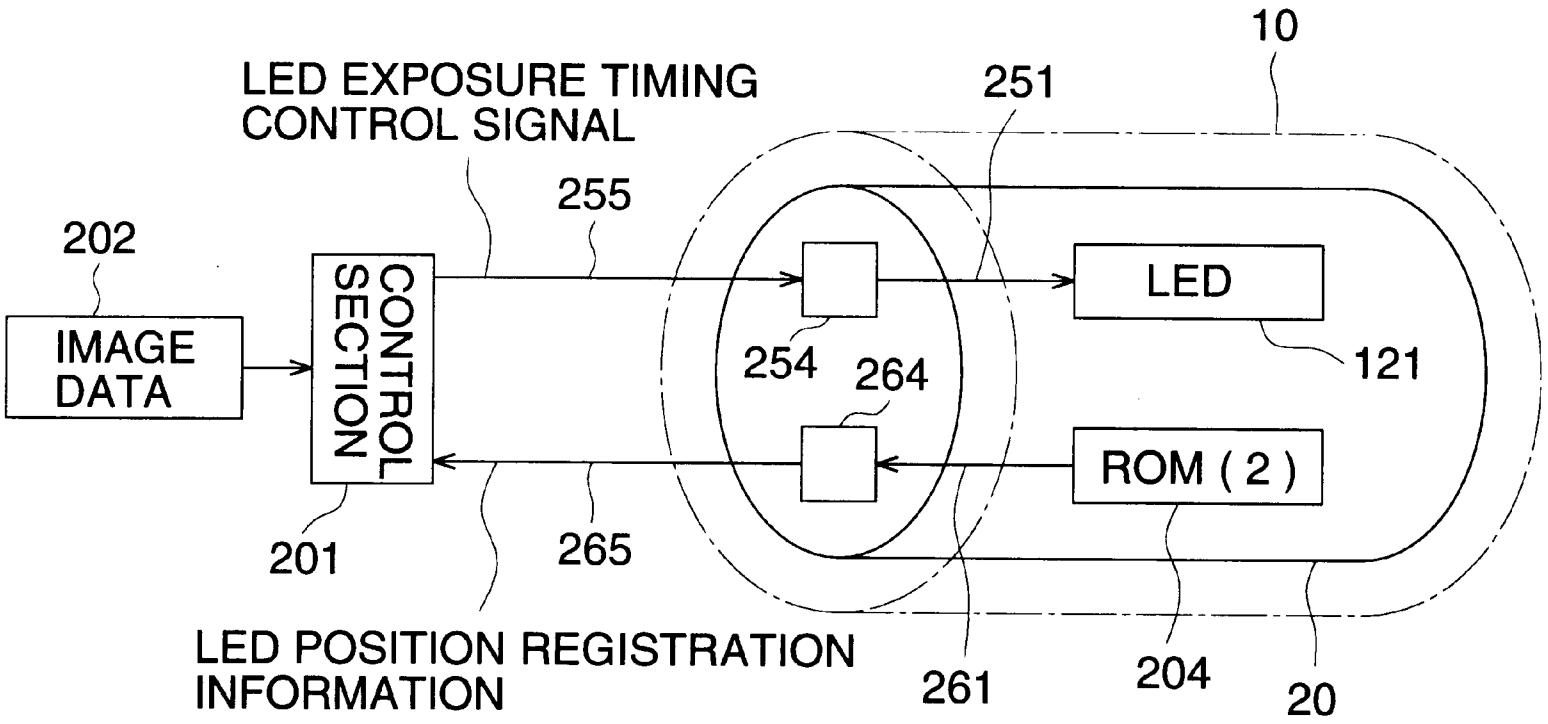
FIG. 20 is an illustration showing how to pick up information from memory members.
Figure 21:
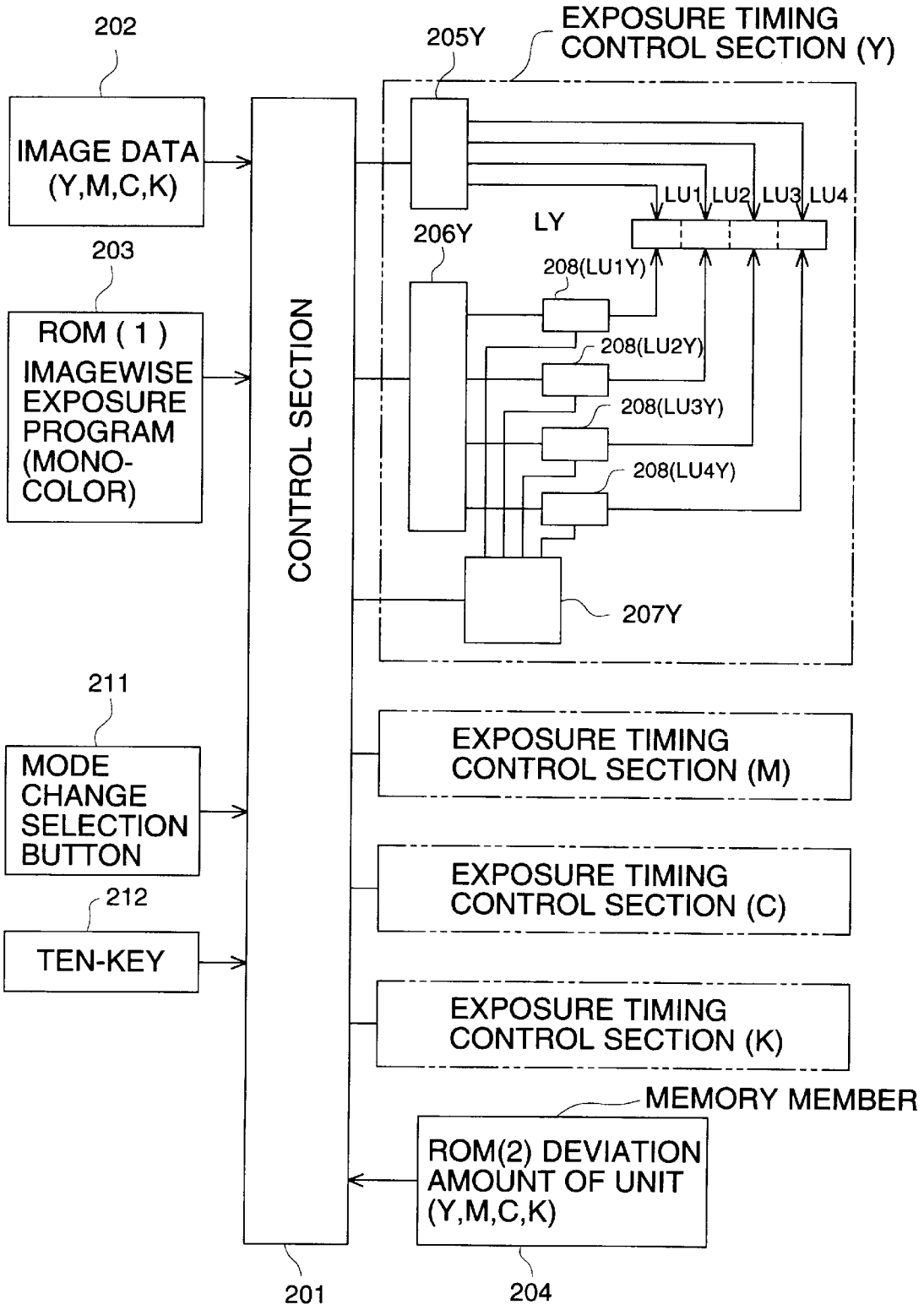
FIG. 21 is a block diagram showing a circuit of the image exposing control means of the invention.
Figure 22:
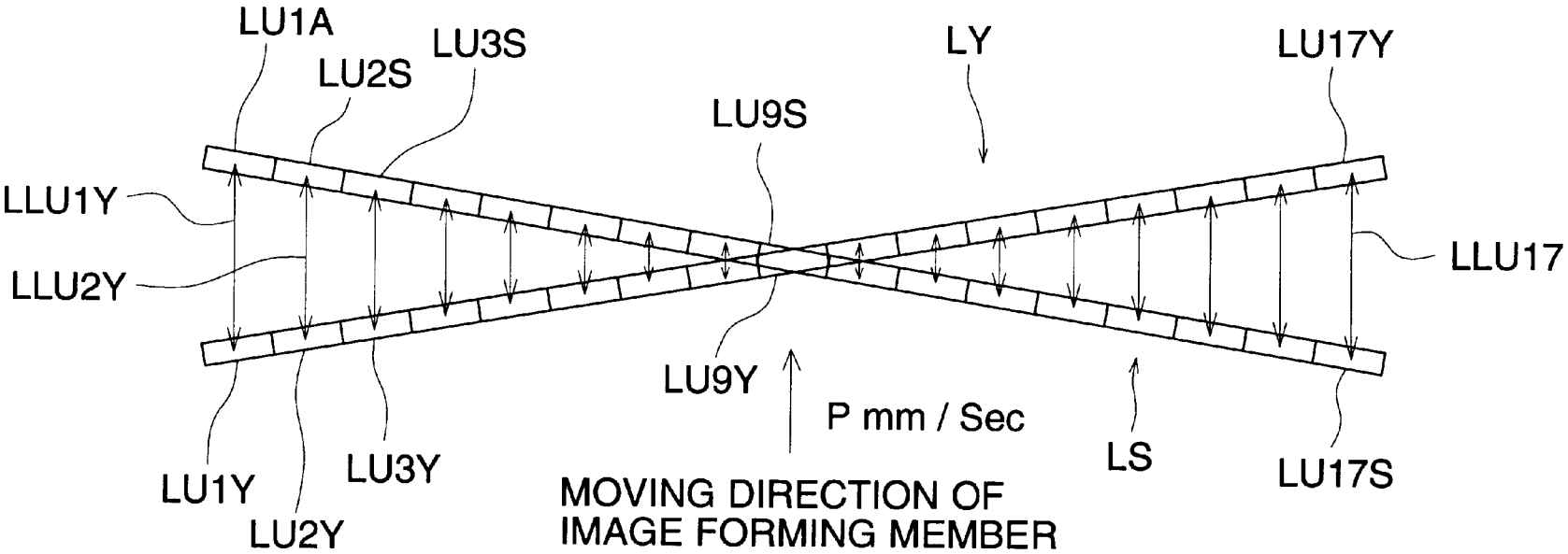
FIG. 22 is an explanatory view showing a relationship among deviations on the LED array.
Figure 24:
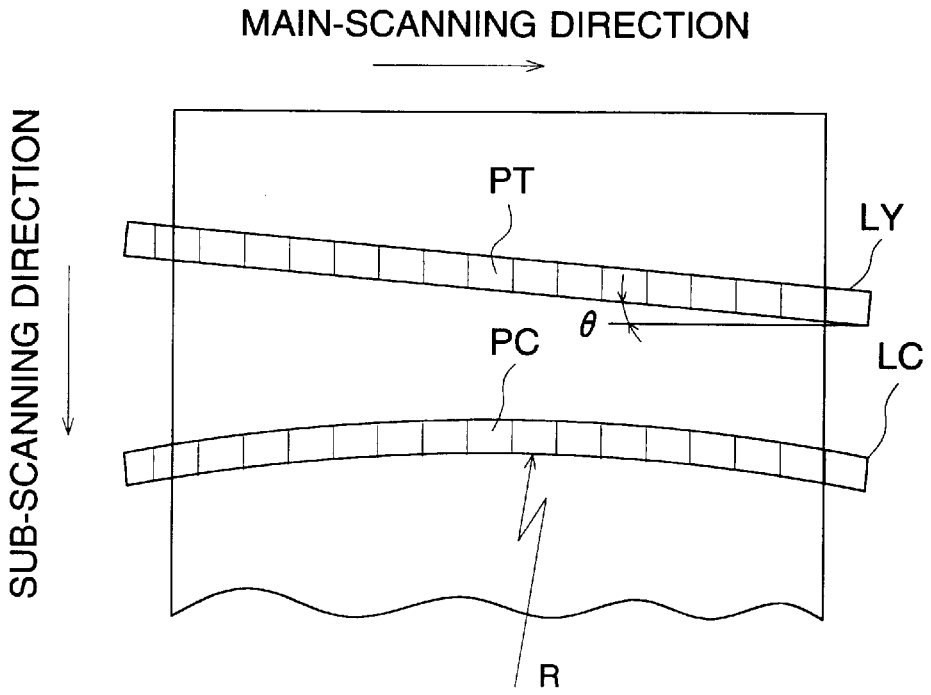
FIGS. 24(*a*) and 24(*b*) are explanatory views showing a second example of a result of the exposing timing control of the invention.
Figure 24:
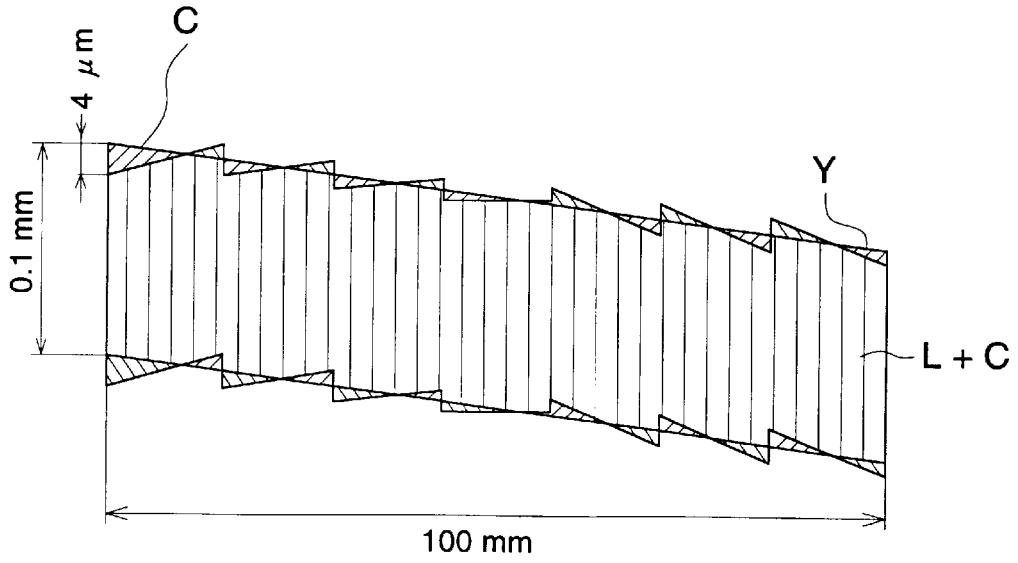
Figure 25:
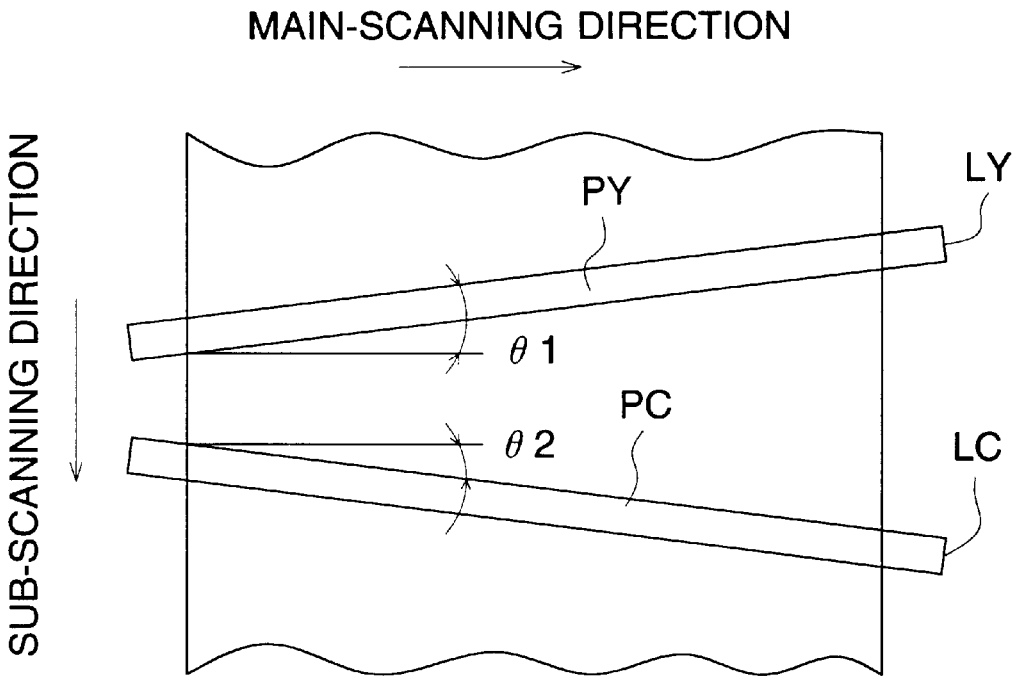
FIGS. 25(*a*) and 25(*b*) are explanatory views showing an example of a result of the conventional exposing timing control.
Figure 25:
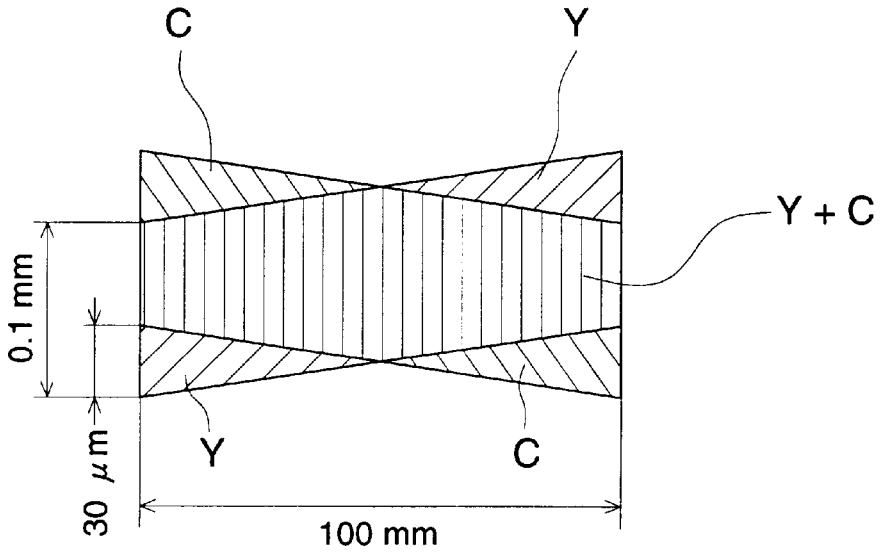
Figure 27:
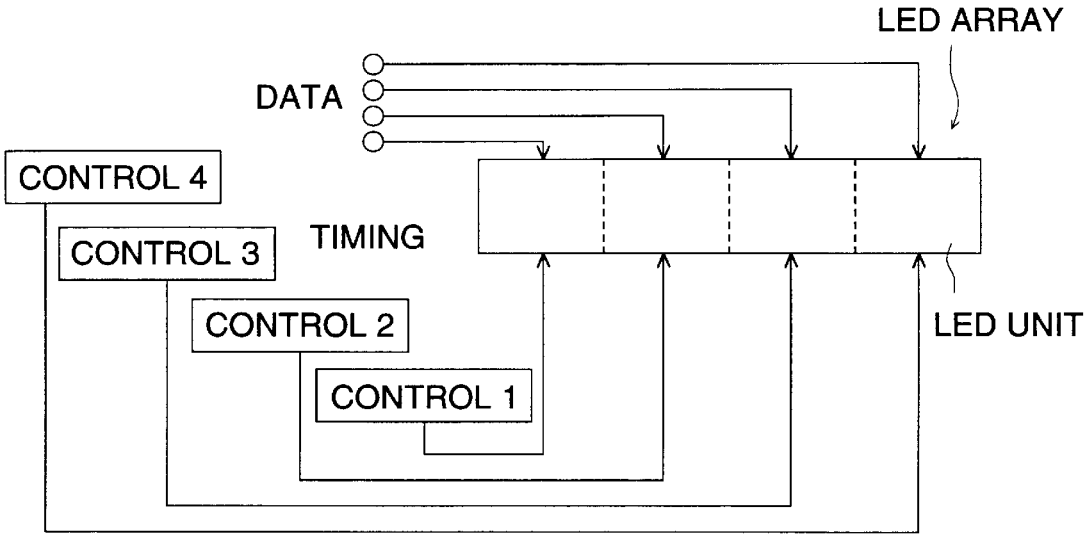
FIG. 27 is an explanatory view showing a exposing timing control system of the invention.
Figure 28:
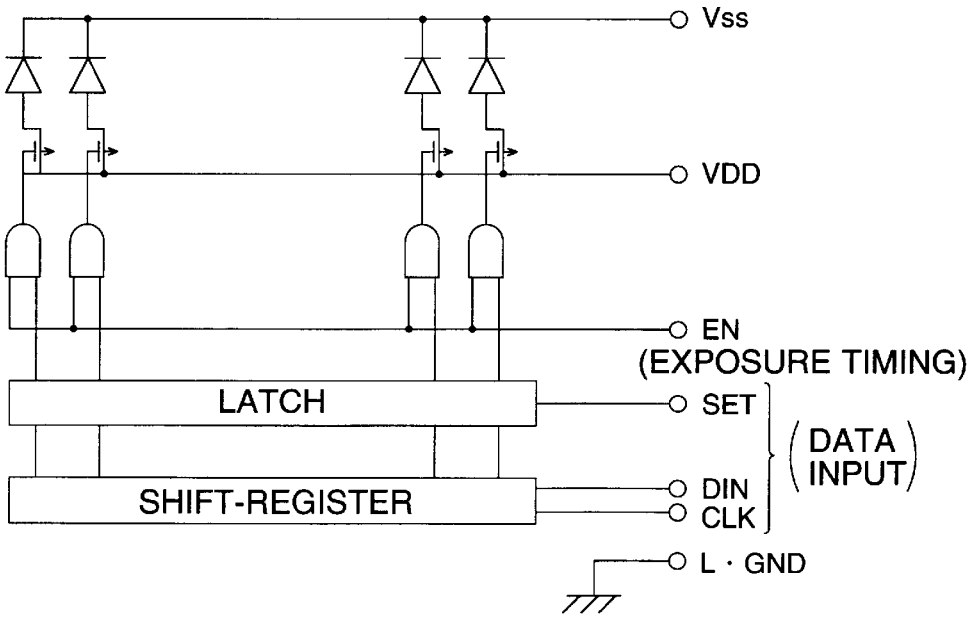
FIG. 28 is a view showing an equivalent circuit of LED array.

Positional registration for image exposure means is now explained with reference to FIGS. 20 through 28, FIG. 3, FIG. 4 and FIG. 6. FIG. 20 is an illustration showing how to pick up information from memory members. FIG. 21 is a block diagram showing a circuit of the image exposing control means of the invention. FIG. 22 is an explanatory view showing a relationship among deviations on the LED array. FIG. 23 is an explanatory view showing a first example of a result of the exposing timing control of the invention. FIG. 24 is an explanatory view showing a second example of a result of the exposing timing control of the invention. FIG. 25 is an explanatory view showing an example of a result of the conventional exposing timing control. FIG. 26 is an explanatory view showing a conventional exposing timing control system. FIG. 27 is an explanatory view showing a exposing timing control system of the invention. FIG. 28 is a view showing an equivalent circuit of LED array.

As explained in FIGS. 3, 4 and 6, a connector 252 provided at a tip end of a lead wire 255 extended from a control section 201 in the apparatus body is coupled with a relay terminal 253 with which a lead wire 251 extended from LED 121 of the exposure optical system 12 of each color, the transfer-simultaneous exposing device 12*g* and a light detection sensor 12*f* is coupled. Further, a connector 254 of a lead wire 265 extended from the control section 201 in the apparatus body is coupled with a relay terminal 263 with which a lead wire 261 extended from ROM(2) is coupled. The lead wires 255 and 256 are drawn out from the inside of the casing 101 to the outside through lead wire drawing-out holes 102*c* and 102*d* provided on the front plate 102.

For each drum unit 300 in which the photoreceptor drum 10 and the exposure optical system 12 mounted on the supporting member 20 are constructed in one body, or for each the exposure optical system 12 fixed on the supporting member 20 mounted on a reference photoreceptor drum, positional registration adjustment is conducted for the exposure optical system for each color by using a reference image forming apparatus and positional registration information is set and memorized in ROM(2) as a memory member. The ROM(2) 204 is provided on the supporting member 20.

Accordingly, information memorized in the ROM(2) 204 provided on the supporting member 20 such as the positional registration information is read out the lead wire 261, the relay terminal 263 and the lead wire 265. On the other hand, image data are outputted on the basis of LED exposure timing control signals from the control section 201 through the lead wire 255, the relay terminal 254 and the lead wire 251 to the LED 121 as light emitting elements, thereby conducting image writing.

In the time of setting a main body of an image forming apparatus or in the time of replacing the drum unit 300 with a spare one, the positional registration information is read out from the ROM(2) 204 mounted on the supporting member 20 of a new drum unit 300 to the control section 201 in the main body of the apparatus and the image data are outputted to the LED 121 on the basis of the newly read-out information, thereby conducting image writing.

LED array in which LEDs 121 are arranged in a line form has a structure shown in FIG. 28 as an equivalent circuit. In the case that the LED array is used as the image exposure means, usually, timings of image data transmission and image exposure are determined so that exposure is conducted simultaneously over the entire region of the LED array as shown in FIG. 26(*a*). In order to get appropriate response time in the circuit, the LED array is divided into plural units and the image data transmission is conducted separately as shown in FIG. 26(*b*) or 26(*c*). In this case, timing of image exposure is so determined that the exposure is conducted simultaneously over the entire region of the LED array. Even if the image exposure of the plural units are conduced separately, since the exposure is conducted simultaneously over the entire region of the LED array, an inclination or a curve of the LED array may causes an inclination or a curve of an exposed image.

In contrast, in the present invention, as shown in FIG. 27, image data are transmitted separately for each divided unit of the LED array, a timing of exposure of each divided unit is controlled from the upstream side in terms of the primary scanning direction in accordance with the degree of the inclination or the curve, whereby the inclination or the curve of the LED array is corrected and an excellent image without the influence of the inclination or the curve can be obtained.

According to an imagewise exposure control section of the invention shown in FIG. 21, image information inputted from the outside and those obtained through reading by an image reading device are inputted in control section 201 as image data of each color of Y, M, C and K after being subjected to image-processing. In ROM(1) 203, monochromatic and multi-color imagewise exposure programs are recorded, and when a monochromatic mode is selected by mode selection button 211, the selected monochromatic imagewise exposure program is outputted to control section 201, while, when a color mode is selected , an imagewise exposure program for each color of Y, M, C, and K is outputted to the control section 201.

In the invention, an amount of doubling of each unit generated when an LED array (LS) that is a reference for optical exposure system 12 explained later is superposed on another LED array (L), for example, LED array (LY) of optical exposure system 12(Y) for yellow(Y) is written in ROM(2) 204 to be stored. As an LED array (LS) to be a reference, an LED array (LK) for black (K) is preferably used.

Each LED array(L) is arranged to be a straight line form in the direction perpendicular to the movement direction of photoreceptor drum 10 as shown in FIG. 22, and is divided into plural units (Divided into four in FIG. 21), for example, divided into 17 units(LU) and each unit(LU) of LED array (L) is named as LU1, LU2, . . . , LU17 in succession from the left. An amount of doubling of each unit of LED array (LY) for yellow (Y), for example, for the reference LED array (LS) is written in ROM(2) 204 as doubling amount (LLU1Y, LLU2Y . . . ) of corresponding units (LU1Y for LU1S, LU2Y for LU2S, . . . ) generated when they are superposed on central LU9, for example, that is a reference point for exposure timing.

Following unit doubling amount (K is reference) of various exposure means written in ROM(2) 204,

LLU1Y, LLU2Y, . . . LLU17Y

LLU1M, LLU2M, . . . LLU17M

LLU1C, LLU2C, . . . LLU17C are outputted to control section 201 when a color image is formed.

Now, exposure timing control means shown in FIG. 21 is explained below.

When forming images in the color image forming apparatus of the present example by using a reference image forming apparatus comprising the same image forming process and structure as that explained in FIG. 1, imagewise exposure for yellow (Y) is first carried out on photoreceptor drum 10 which in the charged state.

In the exposure timing control section as the exposure timing control means, an image data buffer section is shown with 205Y, and image data for one line are moved to the image data buffer section 205Y temporarily in the form which is divided for each unit.

An exposure time control circuit is shown with 206Y, and instruction of timing for the start of exposure for LED array (LY) is outputted to exposure time correction circuit for each unit 208(LU1Y, LU2Y, . . . ) by an imagewise exposure program.

An exposure time correction control circuit for each unit is shown with 207Y, and corrected exposure time for each unit is calculated based on doubling amount for each unit of LED array (LY) called out by ROM(2)2 04 (LLU1Y, LLU2Y, . . . LLU17Y). When moving speed on the circumferential surface of photoreceptor drum 10 is P mm/sec, exposure control time for each unit (LU1Y, LU2Y, . . . LU1Y) is LLUnY/P sec (m:1–17), and exposure correction time calculated in terms of doubling amount to accelerate the exposure by an amount of LLUnY/P sec for the upstream side for the movement direction of photoreceptor drum 10 and to delay the exposure by an amount of LLUnY/P sec for the downstream side, is outputted to unit exposure time correction circuit 208 for each unit (LU1Y, LU2Y . . . LU17Y).

On the exposure time correction circuit for each unit 208(LU1Y, LU2Y . . . LU17Y), an output is made in the form that the exposure start timing outputted from exposure time control circuit 206 is corrected by an amount of LLUnY/P sec, and each unit of LED array (LY) conducts imagewise exposure of image data with the aforementioned exposure start timing.

In the present example, imagewise exposure is carried out in the order of yellow (Y), magenta (M), cyan (C) and black (K).

However, imagewise exposure control section (K) for black (K) does not need correction of imagewise exposure timing became LED array (LK) for black (K) is a reference for imagewise exposure timing correction.

A control method in image forming of the invention is extremely effective in color image forming wherein two or more different imagewise exposure means are used so that toner images are superimposed on an image forming object, but, no effect is observed in the case of monochromatic images. In a monochromatic mode, therefore, exposure timing control for each unit related to the invention can be canceled and is canceled automatically in the color image forming apparatus explained above.

An apparatus and control in the invention explained above have an excellent effect for eliminating doubling amount in the case of superimposing toner images. In FIGS. 23 and 24, the effects are explained. For easy explanation, how the exposure timing of LED array (LC) of optical exposure system 12(C) for LED array (LY) of optical exposure system 12(Y) is controlled (will be explained as follow) when forming a green line-shaped image by superposing yellow (Y) toner and cyan (C) toner on the aforementioned apparatus.

The LED array (LY) and the LED array (LC) both mentioned above are arranged to be a straight line in form and to be tilted respectively by angle θ1 and θ2 both opposite in direction each other from the direction perpendicular to the moving direction of photoreceptor drum 10, keeping the predetermined interval in the moving direction of photoreceptor drum 10, as shown in FIG. 23(*a*).

Each LED array is divided into plural exposure units (4 units or more in general, and 17 units in the present example) in its straight line direction. With regard to LED array(LY), a central exposure unit is a reference point PY in terms of exposure timing, and each exposure unit conducts exposure at the same timing. With regard to LED array (LC), on the other hand, a central exposure unit is reference point PC in terms of exposure timing for the aforesaid LED array(LY), and exposure control is made for agreement an imagewise exposure program established in advance.

Timing of imagewise exposure for each of other exposure units is advanced on delayed based on doubling amount inputted in advance against imagewise exposure of each exposure unit of corresponding LED array(LY), and thereby exposure timing is controlled so that the contours of a green (Y+C)toner image may show a fine a serration form as showing in FIG. 16(*b*).

For example, when each exposure unit is divided to be in length of 12.5 mm and angles of θ1 and θ2 of each LED array are respectively within 1 minute, a 0.1 mm-thick and 100 mm-long line-shaped image to be formed on the circumferential surface of photoreceptor drum 10 can form a green image area wherein two colors (Y+C) mostly agree expect that minute monochromatic areas of yellow (Y) or cyan(C) only which are about 4 μm in size and can not be observed are mixed in the contours portion in a serration form mentioned above.

Thus, it is possible to obtain color images with high image quality wherein no doubling is observed in practical use.

The control of exposure timing for individual exposure unit of LED array mentioned above can be utilized also for an adjustment of exposure timing of an LED array which is not in a straight line form as shown in FIG. 24(*a*).

LED array (LY) shown in FIG. 24(*a*) is in a form of a straight line inclined by an angle of θ from the direction perpendicular to the moving direction of photoreceptor drum 10, and LED array (LC), on the other hand, is an LED array curved to be a form a circular are with radius of curvature R for the moving direction of the photoreceptor drum 10.

Under the condition that the aforesaid LED array (LY) and LED array (LC) are divided respectively into plural exposure units depending on the sizes of the angle θ and radius curvature R mentioned above, and central exposure units are made to be reference point PL and reference point PC respectively for timing control, as in the previous example, it is possible to limit a monochromatic area to an invisible size by advising or delaying exposure timing of each exposure unit on the part of LED array (LC) based on doubling amount inputted in advance for imagewise exposure of exposure unit on the part of corresponding LED array(LY).

Incidentally, when exposure timing is controlled by respective central reference points PY and PC integrally without using the control method of the invention and without dividing the aforementioned LED array (LY) and LED array (LC) into plural exposure units as in a conventional way as shown in FIG. 18(*a*), caused by inclination of the LED array appears noticeably, and when the inclination angles θ1 and θ2 of the LED array are made to be 1 minute as in the previous example, a monochromatic area of yellow (Y) only and that of cyan (C) only generated on an image having thickness of 0.1 mm and length of 100 mm appear to be 30 μm and doubling is clearly observed, resulting in great deterioration of color images.

In the above description, it is explained that the exposure control section for each color is provided in the apparatus body. However, the following structure also can be used in the present invention. The exposure control section for each color is stored in ROM(2) 204 in advance. In the time of setting the main body of the image forming apparatus or in the time of replacing the drum unit 300, positional registration information and exposure timing control information are read out by the control section 201 of the apparatus main body from the ROM(2) 204 mounted on the supporting member 20 of the newly provided drum unit 300. Then, the image data are transmitted with the LED exposure timing control signals based on the newly read-out information to the LED 121, whereby the image writing is conducted.

With the above structure, in the time of setting the main body of the image forming apparatus or in the time of replacing a photoreceptor drum, the correction in the positional registration for the image exposure means is not needed.

Figure 29:
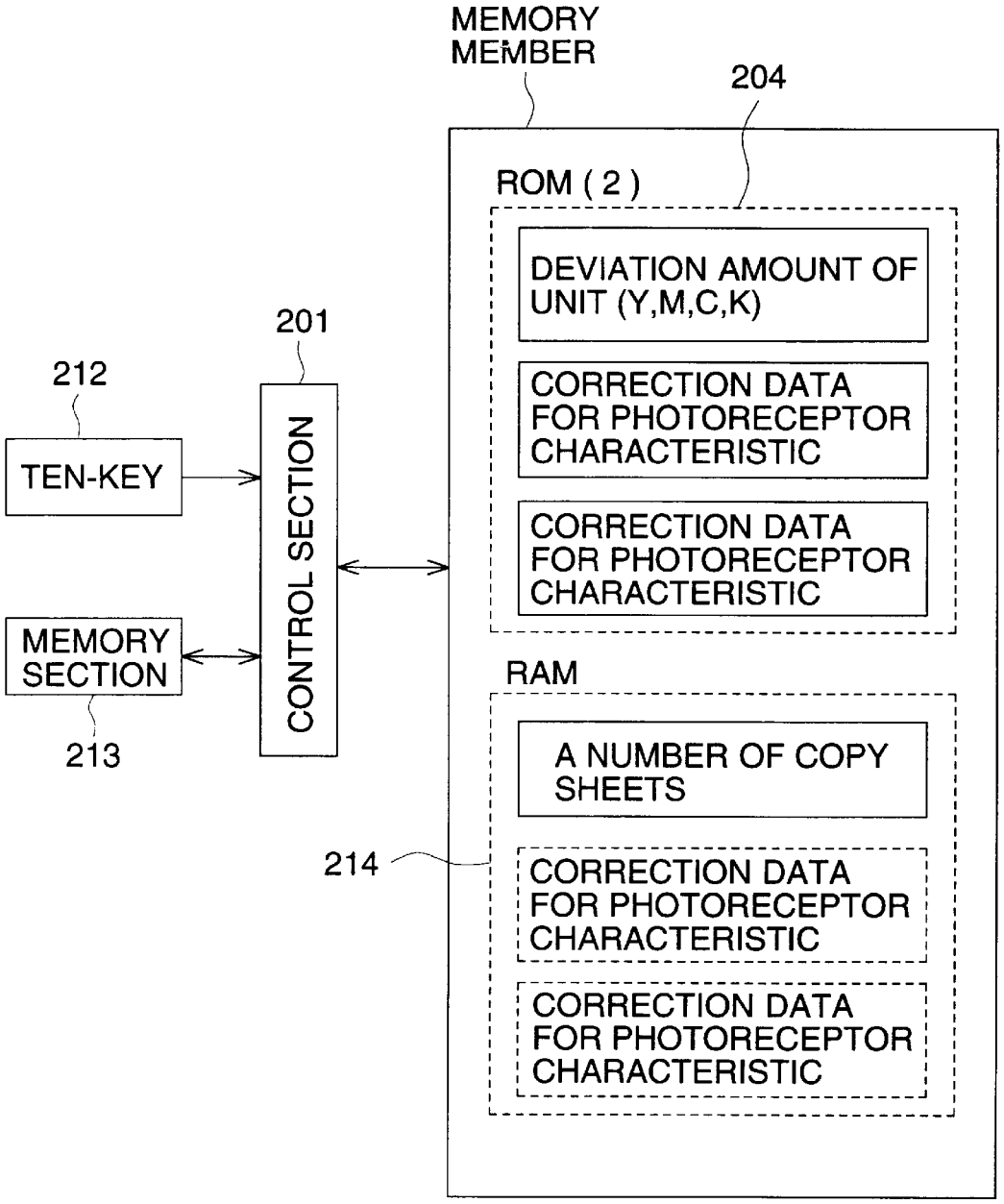
FIG. 29 is a view showing another information to be stored in the memory member.

Another information to be stored in the memory member is shown in FIG. 29. Initial data such as initial photoreceptor characteristic correction data of the photoreceptor drum 10 and initial exposure amount correction data of the LED 121 provided in exposure elements 12*a*, and history data such as photoreceptor characteristic correction data and exposure amount correction data corresponding to a number of copied sheets are memorized in ROM(2) 204 in advance. Then, in the time of setting the main body of the image forming apparatus or in the time of replacing the drum unit 300, the initial photoreceptor characteristic correction data and the initial exposure amount correction data are read out by the control section 201 of the apparatus main body from the ROM(2) 204 mounted on the supporting member 20 of the newly provided drum unit 300, and image formation is conducted based on the newly read-out information. Further, in comparison with a number of copied sheets memorized in a memory section 213 in the control section 201, image formation is conducted based on the photoreceptor characteristic correction data and the exposure amount correction data corresponding to the number of copied sheets.

Furthermore, a memory member may be composed of ROM(2) 204 and RAM 214. In the time of replacing only the photoreceptor drum 10, the initial photoreceptor characteristic correction data of a newly provided photoreceptor drum 10, the initial exposure amount correction data, the photoreceptor characteristic correction data corresponding to a number of copied sheets and exposure amount correction data corresponding to a number of copied sheets are inputted by means of key board in an operating section and are stored in RAM 214. Then, image formation can be conducted based on the above data. Also, a number of copied sheets is memorized in RAM 214 from the control section 201. In comparison with the number of copied sheets memorized in the RAM, image formation can be conducted based on the photoreceptor characteristic correction data and the exposure amount correction data corresponding to the number of copied sheets. It may be also possible to memorize dimensions of an external figure as information of the photoreceptor drum 10.

With the above structure, correction for the photoreceptor characteristic or correction for exposure amount of image exposing means are not needed to conduct for each replacement of the photoreceptor drum.

What is claimed is:

1. An image forming drum unit adapted for mounting on or dismounting from an image forming apparatus as a single unit, comprising:

(1) an image forming drum having an outer surface comprising a photoconductive layer and an inner space;

(2) an exposing unit provided in said inner space of said image forming drum and comprising:

(a) plural exposing members to conduct image exposure in said inner space, (b) a supporting member on which said plural exposing members are mounted;

(c) two sets of bearings for rotatably supporting said image forming drum, wherein said two sets of bearings are mounted on said supporting member and said plural exposing members are placed between said two sets of bearings; and (d) a signal passage for transmission of image signals to said plural exposing members to form an image, said signal passage passing through a part of said supporting member whereby said image signals are supplied through said signal passage from outside of said image forming drum unit to said plural exposing members.

2. The image forming drum unit of claim 1 wherein said supporting member is provided with a uniform exposure means for conducting uniform exposure of said image forming drum when a toner image is transferred from said image forming drum, and said signal passage comprises a lead wire connected to said uniform exposure means.

3. The image forming drum unit of claim 1 wherein said supporting member is provided with a light detecting sensor for conducting toner concentration correction or γ-correction, and said signal passage comprises a lead wire connected to said light detecting sensor.

4. The image forming drum unit of claim 1 wherein said signal passage comprises a lead wire.

5. The image forming drum unit of claim 4 wherein said supporting member is provided with a relay connector forming a part of said signal passage.

6. The image forming drum unit of claim 1 wherein said supporting member is provided with a memory member for memorizing positional registration information among said image forming drum and said plural exposing means, and said signal passage comprises a lead wire connected to said memory member.

7. The image forming drum unit of claim 6 wherein said positional registration information is read out from said memory member through said signal passage and said image signal is transmitted based on said read out positional registration information.

8. The image forming drum unit of claim 1 wherein said supporting member comprises two disk plates and a bar fixed therebetween, said plural exposing members are mounted on said bar and said two sets of bearings are mounted on said two disk plates.

9. The image forming drum unit of claim 8 wherein one of said two disk plates is provided with a hole and said signal passage passes through said hole.

10. The image forming drum unit of claim 9 wherein said image forming drum has a first end and a second end, said second end forming a driven section through which said image forming drum is rotated, and wherein one of said two disk plates is located at said second end of said image forming drum.

* * * * *